US009677188B2

(12) United States Patent
Stowell et al.

(10) Patent No.: US 9,677,188 B2
(45) Date of Patent: Jun. 13, 2017

(54) ELECTROFILL VACUUM PLATING CELL

(71) Applicant: Novellus Systems, Inc., Fremont, CA (US)

(72) Inventors: R. Marshall Stowell, Wilsonville, OR (US); Jingbin Feng, Lake Oswego, OR (US); David W. Porter, Sherwood, OR (US)

(73) Assignee: Novellus Systems, Inc., Fremont, CA (US)

( * ) Notice: Subject to any disclaimer, the term of this patent is extended or adjusted under 35 U.S.C. 154(b) by 481 days.

(21) Appl. No.: 14/102,239

(22) Filed: Dec. 10, 2013

(65) Prior Publication Data

US 2014/0097088 A1 Apr. 10, 2014

Related U.S. Application Data

(63) Continuation-in-part of application No. 12/684,792, filed on Jan. 8, 2010, now abandoned, and a (Continued)

(51) Int. Cl.

*C25D 21/04* (2006.01)
*C25D 5/22* (2006.01)

(Continued)

(52) U.S. Cl.

CPC ..... *C25D 5/22* (2013.01); *C25D 5/003* (2013.01); *C25D 5/02* (2013.01); *C25D 5/04* (2013.01);

(Continued)

(58) Field of Classification Search

CPC ..... C25D 21/04

See application file for complete search history.

(56) References Cited

U.S. PATENT DOCUMENTS 1,255,395 A 2/1918 Duram
3,360,248 A 12/1967 Lindeman et al.

(Continued)

FOREIGN PATENT DOCUMENTS

CN 102286760 A 12/2011
CN 102677139 A 9/2012

(Continued)

OTHER PUBLICATIONS

U.S. Appl. No. 15/181,150, filed Jun. 13, 2016 entitled "Methods and Apparatus for Wetting Pretreatment for Through Resist Metal Plating".

(Continued)

*Primary Examiner* — Bryan D. Ripa

(74) *Attorney, Agent, or Firm* — Weaver Austin Villeneuve & Sampson LLP

(57) ABSTRACT

The disclosed embodiments relate to methods and apparatus for immersing a substrate in electrolyte in an electroplating cell under sub-atmospheric conditions to reduce or eliminate the formation/trapping of bubbles as the substrate is immersed. Various electrolyte recirculation loops are disclosed to provide electrolyte to the plating cell. The recirculation loops may include pumps, degassers, sensors, valves, etc. The disclosed embodiments allow a substrate to be immersed quickly, greatly reducing the issues related to bubble formation and uneven plating times during electroplating.

27 Claims, 11 Drawing Sheets

Related U.S. Application Data continuation-in-part of application No. 12/684,787, filed on Jan. 8, 2010, now Pat. No. 8,962,085.

(60) Provisional application No. 61/735,971, filed on Dec. 11, 2012, provisional application No. 61/773,725, filed on Mar. 6, 2013, provisional application No. 61/218,024, filed on Jun. 17, 2009.

(51) Int. Cl.

| | |
|---|---|
| ***C25D 17/00*** | (2006.01) |
| ***C25D 7/12*** | (2006.01) |
| ***C25D 5/02*** | (2006.01) |
| ***C25D 5/00*** | (2006.01) |
| ***C25D 5/04*** | (2006.01) |
| ***C25D 21/12*** | (2006.01) |
| ***C25D 21/18*** | (2006.01) |
| *C25D 3/38* | (2006.01) |

(52) U.S. Cl.

CPC ..... *C25D 7/123* (2013.01); *C25D 17/001* (2013.01); *C25D 21/04* (2013.01); *C25D 21/12* (2013.01); *C25D 21/18* (2013.01); *C25D 3/38* (2013.01)

(56) References Cited

U.S. PATENT DOCUMENTS 3,849,002 A 11/1974 Hach
4,101,919 A 7/1978 Ammann
4,229,191 A 10/1980 Moore
4,297,217 A 10/1981 Hines et al.
4,816,081 A 3/1989 Mehta et al.
5,000,827 A 3/1991 Schuster et al.
5,221,449 A 6/1993 Colgan et al.
5,281,485 A 1/1994 Colgan et al.
5,427,674 A 6/1995 Langenskiold et al.
5,482,611 A 1/1996 Helmer et al.
5,555,234 A 9/1996 Sugimoto
5,800,626 A 9/1998 Cohen et al.
5,831,727 A 11/1998 Stream
5,982,762 A 11/1999 Anzai et al.
5,985,762 A 11/1999 Geffken et al.
6,004,470 A 12/1999 Abril
6,017,437 A 1/2000 Ting et al.
6,074,544 A 6/2000 Reid et al.
6,099,702 A 8/2000 Reid et al.
6,110,346 A 8/2000 Reid et al.
6,124,203 A 9/2000 Joo et al.
6,126,798 A 10/2000 Reid et al.
6,139,712 A 10/2000 Patton et al.
6,156,167 A 12/2000 Patton et al.
6,159,354 A 12/2000 Contolini et al.
6,162,344 A 12/2000 Reid et al.
6,179,973 B1 1/2001 Lai et al.
6,179,983 B1 1/2001 Reid et al.
6,193,854 B1 2/2001 Lai et al.
6,193,859 B1 2/2001 Contolini et al.
6,217,716 B1 4/2001 Fai Lai
6,221,757 B1 4/2001 Schmidbauer et al.
6,251,242 B1 6/2001 Fu et al.
6,261,433 B1 7/2001 Landau
6,274,008 B1 8/2001 Gopalraja et al.
6,277,249 B1 8/2001 Gopalraja et al.
6,333,275 B1 12/2001 Feng et al.
6,413,388 B1 7/2002 Uzoh et al.
6,503,376 B2 1/2003 Toyoda et al.
6,540,899 B2 4/2003 Keigler
6,544,585 B1 * 4/2003 Kuriyama ..... H01L 21/6715 216/18
6,551,487 B1 * 4/2003 Reid ..... H01L 21/2885 205/137
6,562,204 B1 5/2003 Mayer et al.
6,569,299 B1 5/2003 Reid et al.
6,582,578 B1 6/2003 Dordi et al.
6,596,148 B1 * 7/2003 Belongia ..... C25D 21/18 204/237
6,689,257 B2 2/2004 Mishima et al.
6,716,332 B1 * 4/2004 Yoshioka ..... C23C 18/1605 204/227
6,753,250 B1 6/2004 Hill et al.
6,800,187 B1 10/2004 Reid et al.
6,964,740 B2 11/2005 Morse et al.
6,964,792 B1 11/2005 Mayer et al.
7,014,679 B2 3/2006 Parekh et al.
7,097,410 B1 8/2006 Reid et al.
7,270,734 B1 9/2007 Schetty, III et al.
7,303,992 B2 12/2007 Paneccasio et al.
7,670,950 B2 3/2010 Richardson et al.
7,686,927 B1 3/2010 Reid et al.
7,771,662 B2 8/2010 Pressman et al.
7,776,741 B2 8/2010 Reid et al.
8,404,095 B2 3/2013 Perkins et al.
8,795,480 B2 8/2014 Mayer et al.
8,962,085 B2 2/2015 Mayer et al.
8,992,757 B2 3/2015 Willey et al.
9,138,784 B1 9/2015 Hawkins et al.
9,435,049 B2 9/2016 Thorum
9,455,139 B2 9/2016 Buckalew et al.
9,481,942 B2 11/2016 Zhou et al.
9,613,833 B2 4/2017 Chua et al.
9,617,648 B2 4/2017 Thorum et al.
2001/0015321 A1 8/2001 Reid et al.
2001/0035346 A1 11/2001 Maeda
2002/0027080 A1 3/2002 Yoshioka et al.
2002/0029973 A1 3/2002 Maydan
2002/0084183 A1 7/2002 Hanson et al.
2002/0084189 A1 7/2002 Wang et al.
2002/0195352 A1 12/2002 Mayer et al.
2003/0070941 A1 4/2003 Hirao
2003/0116439 A1 6/2003 Seo et al.
2004/0065561 A1 4/2004 Chalyt et al.
2004/0084315 A1 5/2004 Mizohata et al.
2004/0188257 A1 9/2004 Klocke et al.
2004/0198190 A1 * 10/2004 Basol ..... B24B 37/042 451/41
2004/0200725 A1 10/2004 Yahalom et al.
2004/0231794 A1 11/2004 Hongo et al.
2004/0262165 A1 12/2004 Kanda et al.
2005/0026455 A1 2/2005 Hamada et al.
2005/0145482 A1 7/2005 Suzuki et al.
2005/0255414 A1 11/2005 Inabe et al.
2006/0065536 A1 * 3/2006 Jentz ..... C25D 3/38 205/291
2006/0102485 A1 5/2006 Nakano et al.
2006/0141157 A1 6/2006 Sekimoto et al.
2006/0166500 A1 7/2006 Manens et al.
2006/0207886 A1 9/2006 Isono et al.
2006/0266393 A1 11/2006 Verhaverbeke et al.
2006/0283710 A1 12/2006 Cohen et al.
2008/0041423 A1 2/2008 Hardikar et al.
2008/0149487 A1 6/2008 Lee
2008/0200018 A1 8/2008 Kawamoto
2009/0183992 A1 7/2009 Fredenberg et al.
2010/0032310 A1 2/2010 Reid et al.
2010/0044236 A1 2/2010 Mayer et al.
2010/0084275 A1 4/2010 Hanafusa
2010/0116672 A1 5/2010 Mayer et al.
2010/0163078 A1 7/2010 Hsu et al.
2010/0200412 A1 8/2010 Reid et al.
2010/0200960 A1 8/2010 Angyal et al.
2010/0247761 A1 9/2010 Hashimoto
2010/0320081 A1 12/2010 Mayer et al.
2010/0320609 A1 12/2010 Mayer et al.
2011/0043239 A1 2/2011 Tomita et al.
2011/0284386 A1 11/2011 Willey et al.
2012/0175263 A1 * 7/2012 Ganesan ..... C25D 3/38 205/98
2012/0255864 A1 10/2012 Nagai et al.
2012/0292192 A1 11/2012 Ranjan et al.
2013/0143071 A1 6/2013 Kleinle
2013/0171833 A1 7/2013 Buckalew et al.
2013/0264213 A1 10/2013 Roeger-Goepfert et al.

(56) References Cited

U.S. PATENT DOCUMENTS

| | | | |
|---|---|---|---|
| 2014/0230860 | A1 | 8/2014 | Chua et al. |
| 2015/0096883 | A1 | 4/2015 | Mayer et al. |
| 2015/0126030 | A1 | 5/2015 | Yang et al. |
| 2015/0140814 | A1 | 5/2015 | Thorum |
| 2015/0159289 | A1 | 6/2015 | Willey et al. |
| 2015/0179458 | A1 | 6/2015 | Mayer et al. |
| 2016/0222535 | A1 | 8/2016 | Zhou et al. |
| 2016/0258078 | A1 | 9/2016 | Thorum et al. |
| 2016/0281255 | A1 | 9/2016 | Buckalew et al. |

FOREIGN PATENT DOCUMENTS

| | | | |
|---|---|---|---|
| CN | 102786879 | A | 11/2012 |
| CN | 102804343 | A | 11/2012 |
| CN | 103305886 | A | 9/2013 |
| EP | 0 860 866 | | 8/1998 |
| JP | 06151397 | A | 5/1994 |
| JP | H07-72357 | B2 | 8/1995 |
| JP | 2003-129283 | A | 5/2003 |
| JP | 2006-004955 | | 1/2006 |
| JP | 2007-138304 | | 6/2007 |
| JP | 2009-064599 | | 3/2009 |
| KR | 10-1999-0029433 | | 4/1999 |
| KR | 10-2001-0052062 | | 6/2001 |
| KR | 10-2004-0020882 | | 3/2004 |
| TW | 200716793 | | 5/2007 |
| TW | I281516 | | 5/2007 |
| TW | 201109481 | A1 | 3/2011 |
| WO | 99/10566 | | 3/1999 |
| WO | 99/41434 | | 8/1999 |
| WO | WO 01/68952 | | 9/2001 |
| WO | 02/062466 | | 8/2002 |
| WO | 2007/112768 | | 10/2007 |
| WO | WO 2010/148147 | | 12/2010 |
| WO | WO 2012/022660 | | 2/2012 |

OTHER PUBLICATIONS

US Office Action, dated May 20, 2016, issued in U.S. Appl. No. 14/182,767.
US Notice of Allowance, dated Jun. 23, 2016, issued in U.S. Appl. No. 14/613,306.
US Notice of Allowance (Corrected Notice of Allowability), dated Jun. 17, 2016, issued in U.S. Appl. No. 13/775,987.
U.S. Appl. No. 14/085,262, filed Nov. 20, 2013, entitled "Alkaline Pretreatment for Electroplating".
U.S. Appl. No. 09/872,340, filed May 31, 2001, entitled "Methods and Apparatus for Bubble Removal in Wafer Wet Processing."
U.S. Appl. No. 13/460,423, filed Apr. 30, 2012, titled "Wetting Wave Front Control for Reduced Air Entrapment During Wafer Entry Into Electroplating Bath."
U.S. Appl. No. 12/961,274, filed Dec. 6, 2010 entitled "Deionized Water Conditioning System and Methods".
US Office Action, dated Aug. 31, 2005, issued in U.S. Appl. No. 09/872,340.
US Office Action, dated Apr. 14, 2005, issued in U.S. Appl. No. 09/872,340.
US Office Action, dated Jan. 18, 2006, issued in U.S. Appl. No. 09/872,340.
US Office Action, dated May 26, 2006, issued in U.S. Appl. No. 09/872,340.
US Office Action, dated Nov. 8, 2006, issued in U.S. Appl. No. 09/872,340.
US Final Office Action, dated Mar. 14, 2007, issued in U.S. Appl. No. 09/872,340.
US Office Action, dated Jun. 27, 2012 in U.S. Appl. No. 12/684,787.
US Office Action, dated Apr. 8, 2013 in U.S. Appl. No. 12/684,787.
US Final Office Action, dated Jul. 24, 2013 in U.S. Appl. No. 12/684,787.
US Office Action, dated Oct. 29, 2013 in U.S. Appl. No. 12/684,787.
US Office Action, dated Apr. 12, 2011, issued in U.S. Appl. No. 12/684,792.
US Final Office Action, dated Jul. 26, 2011, issued in U.S. Appl. No. 12/684,792.
US Office Action, dated Sep. 27, 2013, issued in U.S. Appl. No. 12/684,792.
US Office Action, dated Jun. 6, 2013, issued in U.S. Appl. No. 12/961,274.
US Final Office Action, dated Oct. 28, 2013, issued in U.S. Appl. No. 12/961,274.
PCT International Search Report and Witten Opinion, dated Jan. 5, 2011, issued in PCT/US2010/038901.
PCT International Preliminary Report on Patentability and Written Opinion dated Jan. 5, 2012, issued in PCT/US2010/038901.
KR Office Action, dated Jan. 5, 2012 in KR Application No. 2010-7026340.
Kondo et al., "High Speed Through Silicon Via Filling by Copper Elcctrodcposition," Electrochemical and Solid State Letters, 13 (5) D26-D28 (2010).
U.S. Appl. No. 14/613,306, filed Feb. 3, 2015, entitled "Geometry and Process Optimization for Ultra-High RPM Plating".
U.S. Appl. No. 14/593,676, filed Jan. 9, 2015, entitled "Wetting Pretreatment for Enhanced Damascene Metal Filling".
U.S. Appl. No. 14/326,899, filed Jul. 9, 2014, entitled "Apparatus for Wetting Pretreatment for Enhanced Damascene Metal Filling".
US Final Office Action, dated Mar. 3, 2014 in U.S. Appl. No. 12/684,787.
US Office Action, dated Aug. 26, 2014 in U.S. Appl. No. 12/684,787.
US Notice of Allowance, dated Oct. 10, 2014 in U.S. Appl. No. 12/684,787.
US Notice of Allowance (Supplemental Notice of Allowability), dated Oct. 22, 2014 in U.S. Appl. No. 12/684,787.
US Notice of Allowance (Supplemental Notice of Allowability), dated Oct. 28, 2014 in U.S. Appl. No. 12/684,787.
US Final Office Action, dated Apr. 10, 2014, issued in U.S. Appl. No. 12/684,792.
US Notice of Allowance, dated Jan. 21, 2014, issued in U.S. Appl. No. 12/961,274.
US Office Action, dated Jul. 25, 2014, issued in U.S. Appl. No. 12/961,274.
US Final Office Action, dated Nov. 28, 2014, issued in U.S. Appl. No. 12/961,274.
Chinese First Office Action dated Aug. 14, 2014 issued in CN Application No. 201080026847.7.
Taiwan Office Action dated Nov. 18, 2014 issued in TW Application No. 099119625.
Bozzini et al., (2006) "An electrochemical and in situ SERS study of Cu electrodeposition from acidic sulphate solutions in the presence of 3-diethylamino-7-(4-dimethylaminophenylazo)-5-phenylphenazinium chloride (Janus Green B)", *Journal of Applied Electrochemistry*, 36:973-981.
Kim, S-K., et al. (2006) "Cationic Surfactants for the Control of Overfill Bumps in Cu Superfilling" *Journal of Electrochemical Society*, 153(12):C826-C833.
Luhn et al., (2009) "Filling of microvia with an aspect ratio of 5 by copper electrodeposition," Electrochimica Acta, 54:2504-2508.
U.S. Appl. No. 14/638,750, filed Mar. 4, 2015, entitled "Pretreatment of Nickel and Cobalt Liners for Electrodeposition of Copper Into Through Silicon Vias".
US Office Action, dated Nov. 12, 2015, issued in U.S. Appl. No. 14/182,767.
US Office Action, dated Jun. 5, 2015, issued in U.S. Appl. No. 14/085,262.
US Final Office Action, dated Oct. 23, 2015, issued in U.S. Appl. No. 14/085,262.
US Notice of Allowance, dated May 3, 2016, issued in U.S. Appl. No. 14/085,262.
US Office Action, dated Feb. 5, 2016, issued in U.S. Appl. No. 14/638,750.
US Office Action, dated Oct. 23, 2015, issued in U.S. Appl. No. 14/326,899.

(56) References Cited

OTHER PUBLICATIONS

US Notice of Allowance, dated May 6, 2016, issued in U.S. Appl. No. 14/326,899.
US Office Action, dated Jul. 29, 2015, issued in U.S. Appl. No. 13/775,987.
US Notice of Allowance, dated Mar. 14, 2016, issued in U.S. Appl. No. 13/775,987.
US Notice of Allowance (Corrected Notice of Allowability), dated Apr. 26, 2016, issued in U.S. Appl. No. 13/775,987.
US Notice of Allowance, dated May 27, 2015, issued in U.S. Appl. No. 12/961,274.
Chinese First Office Action dated Nov. 2, 2015 issued in CN 201310676660.7.
Taiwan Office Action dated Mar. 22, 2016 issued in TW Application No. 104118528.
US Notice of Allowance, dated Dec. 21, 2016 issued in U.S. Appl. No. 14/638,750.
Chinese Third Office Action dated Jan. 5, 2017 issued in Application No. CN 201310676660.7.
US Notice of Allowance, dated Nov. 25, 2016, issued in U.S. Appl. No. 14/182,767.
US Notice of Allowability, dated Oct. 12, 2016, issued in U.S. Appl. No. 14/613,306.
US Office Action, dated Aug. 10, 2016, issued in U.S. Appl. No. 14/638,750.
US Notice of Allowance, dated Aug. 26, 2016, issued in U.S. Appl. No. 14/326,899.
Chinese Second Office Action dated Jun. 20, 2016 issued in Application No. CN 201310676660.7.
Chinese First Office Action dated Aug. 3, 2016 issued in Application No. CN 201410658497.6.
Taiwan Examination and Search Report dated Oct. 13, 2016 issued in Application No. TW 102108847.
Chinese First Office Action dated Jul. 7, 2016 issued in Application No. CN 201310080545.3.
Li, Guang et al., (2002) "Quantitative analysis of HBsAg in vaccinum hepatitis B by high performance capillary zone electrophoresis," Analytical Instrumentation, Issue 1, pp. 21-23 [Abstract Only].
Taiwan Examination Report dated Mar. 17, 2017 issued in Application No. TW 102145646.
U.S. Appl. No. 15/424,198, filed Feb. 3, 2017, Chua et al.
Notification of Decision of Final Rejection dated Apr. 7, 2017, issued in Application No. 201310676660.7.

* cited by examiner

| | 10 Torr | 20 Torr | 40 Torr | 760 Torr |
|---|---|---|---|---|
| Boiling Observed in Water (W) or Plating Solution (PS)? | Both W and PS boiled | Intermittent boiling for W and PS | No boiling of W or PS | No boiling of W or PS |
| Difference in RGA results between water and plating solution? | No significant differences | No significant differences | No significant differences | No significant differences |

FIG. 11

ELECTROFILL VACUUM PLATING CELL

CROSS REFERENCE TO RELATED APPLICATIONS

This application claims benefit of prior filed U.S. Provisional Application Nos. 61/735,971, filed Dec. 11, 2012, and titled "ELECTROFILL VACUUM PLATING CELL"; and Ser. No. 61/773,725, filed Mar. 6, 2013, and titled, "ELECTROFILL VACUUM PLATING CELL," each of which is incorporated herein in its entirety and for all purposes. This application is also a continuation-in-part of U.S. patent application Ser. No. 12/684,787, titled "WETTING PRETREATMENT FOR ENHANCED DAMASCENE METAL FILLING," and Ser. No. 12/684,792, titled "APPARATUS FOR WETTING PRETREATMENT FOR ENHANCED DAMASCENE METAL FILLING," both filed Jan. 8, 2010, and both claiming the benefit of priority to U.S. Provisional Application No. 61/218,024, filed Jun. 17, 2009, titled "METHOD AND APPARATUS OF VACUUM-ASSISTED LIQUID BACKFILL WETTING FOR DAMASCENE ELECTROPLATING," all of which are incorporated herein by reference in their entireties and for all purposes.

BACKGROUND

For various reasons, a wafer to be electroplated may be tilted to a non-horizontal angle upon immersion into an electroplating bath. Thus, some existing methods and apparatus for electroplating require that a substrate be immersed in plating solution over a considerable period of time (e.g., 120-200 ms from the time the leading edge enters solution to the time the trailing edge is fully immersed) as compared to the total time it takes to fill features on a substrate (e.g., current technology node wafer structures may fill in about 1-2 s, in some cases in less than about 500 ms). The relatively long immersion time (defined as the time it takes for the entire plating face of the substrate to become immersed in plating solution) results in inconsistent feature fill because the leading edge of the substrate enters the plating solution and begins plating before the trailing edge of the substrate. Initial plating non-uniformities may persist throughout the plating process, resulting in non-uniform fill. These effects will be further exacerbated as the industry moves from 300 mm to 450 mm wafers. Without wishing to be bound by any theory or mechanism of action, the difference in plating start time across the wafer may lead to non-uniform adsorption of additives such as accelerators, suppressors and levelers, which can lead to non-uniform plating across the surface of the wafer. Therefore, it is generally better to have a short immersion time relative to the time it takes to fill small features, so that the difference in fill start time across the wafer can have minimal impact such that feature fill and plating uniformity can be maximized.

One consideration in minimizing immersion time is the formation of bubbles at the interface between the plating solution and the substrate. During wafer immersion into a plating electrolyte, bubbles can be entrapped under the plating side of the wafer (the active side or plating surface). The bubble trapping issue may be exacerbated if the substrate is immersed too quickly. Air bubbles trapped on the plating surface of a wafer can cause many problems. Where bubbles are present, they shield the plating surface of a wafer from exposure to electrolyte, and thus produce a region where plating does not occur. The resulting plating defect can manifest itself as a region of no plating or of reduced plating thickness, depending on the time at which the bubble became entrapped on the wafer and the length of time that it stayed entrapped there. Thus, under current electroplating methods, significant plating defects may occur if the immersion time is too fast.

SUMMARY

The embodiments herein relate to methods and apparatus for electroplating material onto a substrate. In the disclosed embodiments, a substrate is immersed into electrolyte under a low pressure to reduce or eliminate the risk that bubbles become trapped under the substrate as it is immersed. In one aspect of the disclosed embodiments, a method of electroplating metal onto a substrate is provided, including: flowing electrolyte through a plating recirculation loop including an electrolyte reservoir, a pump, an electroplating cell, and a degasser that degasses the electrolyte prior to its introduction to the electroplating cell; immersing the substrate in electrolyte in an electroplating cell, where the pressure in the electroplating cell during immersion is about 100 Torr or less; electroplating material onto the substrate; and removing the substrate from electrolyte.

In some embodiments, the pressure in the electroplating cell during immersion is at least about 20 Torr. Immersing the substrate in electrolyte may occur over a period of about 225 ms or less, where the substrate has a diameter of about 150 mm or greater. In some cases, this immersion duration may be shorter. For example, immersing the substrate in electrolyte may occur over a period of about 50 ms or less, where the substrate has a diameter of about 150 mm or greater. In these or other embodiments, immersing the substrate in electrolyte occurs over a period having a first duration, and electroplating material to fill a feature on the substrate occurs over a period having a second duration, where the first duration is about 10% or less of the second duration. In certain cases, the feature is a smallest feature on the substrate, as measured by volume. The feature may also be a median-sized feature on the substrate, as measured by volume.

The substrate may be immersed at an angle, and in some embodiments the substrate swings to a horizontal orientation at a swing speed between about 0.25-10 degrees/second. The low pressure in the electroplating cell is present at least during immersion, and may persist for a longer period. In some embodiments, the pressure in the electroplating cell remains at or below about 100 Torr during at least the first about 10 ms of plating. In certain cases, the pressure in the electroplating cell remains at or below about 100 Torr until after electroplating ceases. A loadlock may be used in some embodiments. In this case, the method may further include inserting the substrate into a loadlock and reducing the pressure in the loadlock to about 100 Torr or below.

The method may also include injecting gas into the electrolyte after the electrolyte is degassed and before the electrolyte is introduced to the electroplating cell. The injected gas may be oxygen. The oxygen may be injected to an electrolyte concentration of about 10 ppm or less. In certain cases the oxygen may be injected to an electrolyte concentration of about 1 ppm or less.

In certain embodiments, the method further includes flowing electrolyte through a gas control recirculation loop including the electrolyte reservoir and a dissolved gas sensor, where a dissolved gas controller controls a gas injection unit based on input from the dissolved gas sensor in order to regulate a concentration of dissolved gas in the electrolyte. The plating recirculation loop may be separate from the gas control recirculation loop. In some implementations, electrolyte may bypass the electrolyte reservoir of the plating recirculation loop by passing through a bypass conduit during electroplating. Electrolyte may also be flowed through an atmospheric recirculation loop when electroplating is not occurring, where the atmospheric recirculation loop includes the electrolyte reservoir, an atmospheric electrolyte reservoir, and an atmospheric loop pump. The method may also include degassing electrolyte in a degassing electrolyte reservoir, and flowing electrolyte through a degassing recirculation loop and an atmospheric recirculation loop, where the degassing recirculation loop includes the electrolyte reservoir, a degassing loop pump, and a degassing electrolyte reservoir, and where the atmospheric recirculation loop includes the degassing electrolyte reservoir, an atmospheric loop pump, and an atmospheric electrolyte reservoir.

In another aspect of the disclosed embodiments, an apparatus for electroplating metal onto a substrate is provided, including: an electroplating cell configured to withstand pressure below about 100 Torr, including a substrate holder, an electrolyte containment vessel, and a substrate positioning system capable of controlling an orientation of a substrate as it is immersed in the electrolyte containment vessel; a plating recirculation loop including an electrolyte reservoir, a pump, a degasser, and the electroplating cell, where the degasser is positioned after the electrolyte reservoir and before the electroplating cell in the plating recirculation loop; and a plating controller configured to maintain a pressure below about 100 Torr when the substrate is immersed in the electrolyte containment vessel during an electroplating process.

In certain embodiments, the substrate positioning system is capable of controlling translation, tilt and rotation of the substrate. The apparatus may also include a dissolved gas sensor. In some cases, a dissolved gas controller may be used in combination with the dissolved gas sensor and a gas injector, where the dissolved gas controller controls the gas injector based on measurements from the dissolved gas sensor.

A bypass conduit may be used in certain implementations, where the plating controller is configured to flow electrolyte through the bypass conduit to thereby bypass the electrolyte reservoir during electroplating. In some embodiments, an atmospheric recirculation loop may be used, including the electrolyte reservoir, an atmospheric loop pump, and an atmospheric electrolyte reservoir, where the plating controller is configured to prevent the atmospheric recirculation loop from circulating during electroplating. In some implementations, the apparatus may include a degassing electrolyte recirculation loop and an atmospheric recirculation loop, where the degassing electrolyte recirculation loop includes the electrolyte reservoir, a degassing loop pump, and a degassing electrolyte reservoir, and the atmospheric recirculation loop includes the degassing electrolyte reservoir, an atmospheric loop pump, and an atmospheric electrolyte reservoir, where the plating controller is configured to ensure that the degassing electrolyte recirculation loop is not circulating during electroplating. In various cases, the apparatus includes one or more additional electroplating cells configured to operate at or below about 100 Torr, where the additional electroplating cells are in fluidic communication with the electrolyte reservoir.

These and other features will be described below with reference to the associated drawings.

BRIEF DESCRIPTION OF THE DRAWINGS

FIG. 11 is a table showing experimental results for electroplating processes performed at sub-atmospheric and atmospheric pressures.

DETAILED DESCRIPTION

Figure 1:
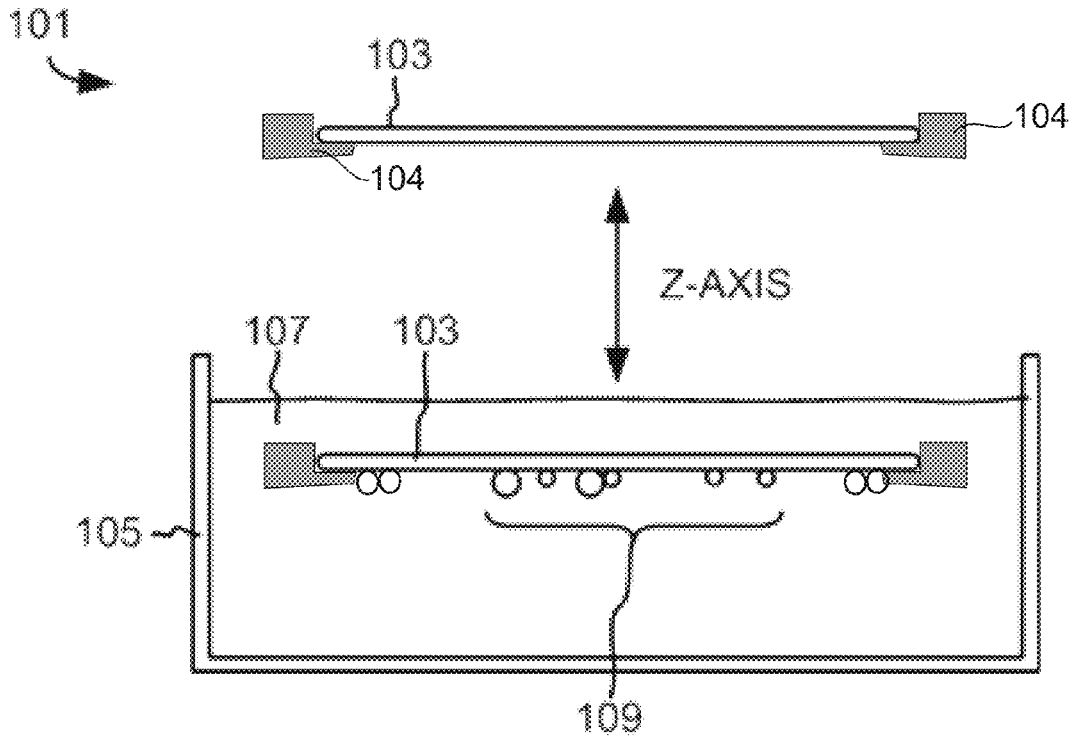
FIGS. 1 and 2 show views of a substrate as it is immersed in electrolyte in an electroplating vessel during horizontal immersion (FIG. 1) and angled immersion (FIG. 2).

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. A wafer or substrate used in the semiconductor device industry typically has a diameter of 200 mm, or 300 mm, or 450 mm. Further, the terms "electrolyte," "plating bath," "bath," and "plating solution" are used interchangeably. The following detailed description assumes the invention is implemented on a wafer. However, the invention is not so limited. The work piece may be of various shapes, sizes, and materials. In addition to semiconductor wafers, other work pieces that may take advantage of this invention include various articles such as printed circuit boards and the like.

In the following description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

The present disclosure is provided in the context of a method and apparatus for electroplating a substrate in vacuum conditions. The vacuum assisted methods and associated hardware disclosed herein allow the substrate to be immersed quickly (e.g., in less than about 50 ms, less than about 35 ms, less than about 20 ms, less than about 10 ms, or between about 5-15 ms) without detrimental bubble formation. Additionally, some disclosed vacuum embodiments permit substrate immersion without application of an electrical bias to the substrate during immersion. Further, some embodiments permit substrate immersion with little or no substrate tilt, so that all portions of the substrate contact electroplating solution at essentially the same time. The various embodiments may be useful in a variety of applications including damascene interconnects (examples of tools that provide this functionality are Sabre™ NExT™, Sabre™ Extreme™, Sabre™ Excel™, Sabre™ Max™, etc. from Lam Research Corporation of Fremont, Calif.), wafer-level packaging (WLP), through-silicon-via (TSV) (an example of a tool that provides this functionality is the Sabre-3D™), and electroless deposition (ELD).

The embodiments herein greatly reduce bubble formation by eliminating gasses at the substrate/fluid interface before and during immersion and by carefully controlling the entry profile of the wafer (the vertical entry speed, tilt angle and rotation speed, for example). This allows faster substrate entry into the electroplating solution and consequently a higher quality, more uniform electroplating/fill over the entire plating surface of the substrate. Further, elimination of oxygen in the plating environment reduces the deleterious effects of metal corrosion at the wafer face.

As described above, bubble formation leads to significant plating defects including reduced plating or no plating at locations where bubbles were present. This bubble formation is especially likely when the wafer is immersed in a horizontal or substantially horizontal orientation (parallel to a plane defined by the surface of the electrolyte) along a vertical immersion trajectory. FIG. 1 shows a cross-sectional diagram of a typical bubble-entrapment scenario arising in an electroplating system 101. A horizontally oriented wafer, 103, held by wafer holder 104, is lowered towards an electrolyte 107 in a vessel 105 along a vertical Z-axis and is ultimately immersed in the electrolyte 107. Vertical immersion of a horizontally oriented wafer 103 results in air bubbles 109 being trapped on the underside (plating surface) of wafer 103. In an inverted (face down) configuration, buoyancy forces tend to pull bubbles upwards and onto the wafer's active surface. These bubbles are difficult to remove from the wafer surface because the plating cell has no intrinsic mechanism for driving the bubbles around the wafer edges, the only path off the wafer surface. In addition, some embodiments utilize a holding fixture (e.g., wafer holder 104 of FIG. 1) at the wafer edge that supports the wafer during immersion—the holder exacerbates bubble entrapment by presenting a surface perpendicular to the wafer surface which prevents bubbles from leaving the wafer surface. Typically, wafer 103 is rotated about an axis that passes through its center and is perpendicular to its plating surface. This rotation helps to dislodge bubbles through centrifugal force, but many of the smaller bubbles are tenacious in their attachment to the wafer, and are not removed by the rotation.

Angled Immersion

Figure 2:
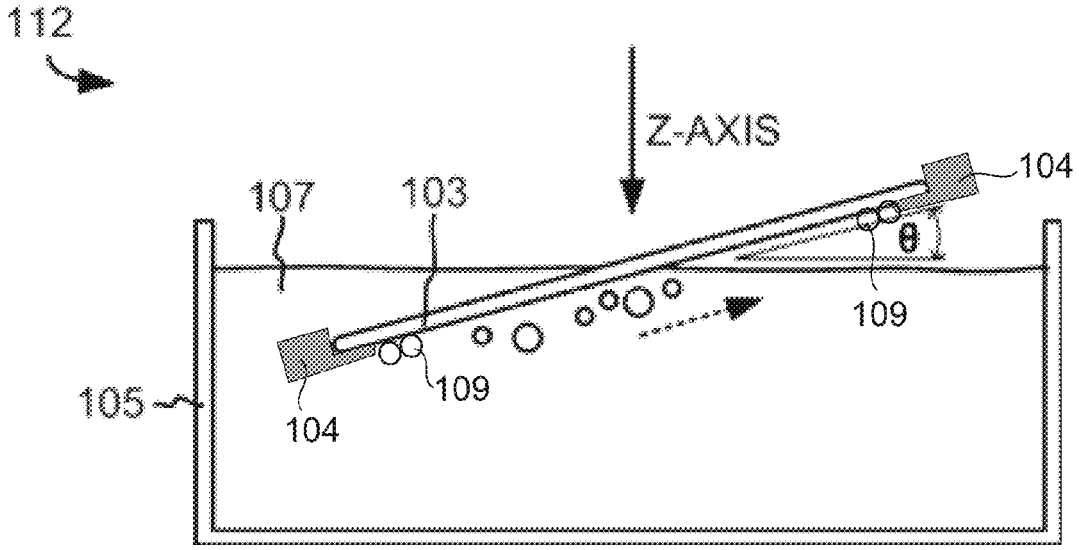

One way to address a number of the above-described issues is to use angled wafer immersion. In this method, the wafer is tilted relative to a plane defined by the surface of the electrolyte, while being introduced into the electrolyte along a vertical path (along a Z-axis). FIG. 2 depicts such an immersion scenario 112, where wafer 103 is immersed in electrolyte 107 along a Z-axis, while the wafer is also tilted relative to the surface of the electrolyte 107, in this example, at an angle, θ. Using angled immersion, bubbles that may otherwise be trapped on the wafer surface are aided by buoyancy and pushed by the wave advancing from the leading immersion edge toward the trailing immersion edge, and are therefore no longer trapped but can escape to the atmosphere since the wafer is tilted. Also, a single wetting front is established, so there are no issues with convergent wetting fronts. Angled wafer immersion is described in more detail in U.S. Pat. No. 6,551,487, and U.S. patent application Ser. No. 13/460,423, filed Apr. 30, 2012, titled "WETTING WAVE FRONT CONTROL FOR REDUCED AIR ENTRAPMENT DURING WAFER ENTRY INTO ELECTROPLATING BATH," which are each incorporated by reference herein in their entireties. Rotation speed may complement angled immersion to reduce bubble formation. As mentioned above, wafer holders may exacerbate bubble entrapment.

While angled immersion significantly reduces bubble formation in electroplating cells operated at atmospheric pressure, it introduces a challenge. The plating face of the substrate contacts the solution over a period of time, with some regions of the face contacting the solution before other regions of the face. As a consequence, some regions may establish fully developed concentration and adsorption profiles of plating additives (accelerators, suppressors, and/or levelers) while other regions are just coming in contact with the additives. When electroplating begins, those regions with fully developed additive profiles electroplate better than other regions without fully developed additive profiles. Further, when the substrate is electrically biased during entry, regions of the substrate that first contact the electroplating solution begin plating well before regions of the substrate that contact the solution later. As a consequence, over the course of plating, the leading edge portions of the substrate plate to a greater extent than the trailing edge portions. In an atmospheric pressure electroplating cell, the amount of time required for angled immersion can be a significant fraction of the total time required for filling recessed features during electroplating, especially the relatively smaller features. The resulting non-uniformity is undesirable.

The angle of the wafer during immersion can be less than about 3 degrees from the horizontal in certain implementations of a vacuum cell. In some embodiments, the angle is about 2 degrees or less. In some embodiments, the angle is about 1 degree or less.

In certain embodiments, the angle the wafer is tilted is changed during the immersion protocol. This can result in reduced entrapment of bubbles. In these embodiments, the "swing speed," that is, the speed at which the wafer is tilted from 0 to horizontal, and vice versa, may be controlled so as not to create turbulence and thus introduce unwanted air entrapment. However, as with many events in a high throughput environment, there is a tradeoff between performance and throughput. In particular, if the swing speed is too slow, throughput suffers, and if swing speed is too fast, turbulence may be the result. In one embodiment, the swing speed of the wafer is between about 0.25-10 degrees per second. In another embodiment, the swing speed is between about 0.25-1.5 degrees per second. In another embodiment, the swing speed is between about 0.5-1 degrees per second. In a further embodiment, the swing speed is above about 1 degree per second. Active tilt angle control can be used independently of Z-speed variation, or in combination with Z-speed variation, for reduced air bubble entrapment. In some embodiments, the leading edge of the wafer contacts the plating solution while the wafer is tilted at a first angle to the horizontal; then the tilt of the wafer is increased to a second angle, followed by decrease to, for example, zero degree angle. In other embodiments the leading edge of the wafer contacts the plating solution while the wafer is tilted at a first angle to horizontal, then the tilt angle is decreased to a smaller tilt angle, before finally decreasing the tilt angle to zero degrees.

In certain implementations, the tilt angle is established prior to immersion and held constant during the immersion process.

The wafer may also be rotated during immersion. Like tilting, wafer rotation may be implemented any time along the wafer's vertical trajectory to the electrolyte, so long as it is rotating upon entry into the electrolyte. For immersing the wafer, in one embodiment, the rotational speed is between about 10-180 RPM for a 200 mm diameter wafer, about 5-180 RPM for a 300 mm wafer, and about 5-150 RPM for a 450 mm wafer. Different rotation speeds may be used for immersion (a first rotational speed) vs. plating (a second rotational speed) and also post plating (further plating speeds). For example, the wafer may be spun at particular speeds to recover electrolyte from the wafer after removing it from the bath, and, for example, when rinsing the electrolyte from the plated wafer. These rotational details, along with exemplary hardware for carrying out angled immersion methods, are described in more detail in U.S. Pat. No. 6,551,487, incorporated by reference above.

The vertical entry speed of the wafer may be constant or variable during immersion. The vertical speed may be varied to provide an optimal wetting profile for the wafer. For example, in certain implementations, the wafer accelerates and/or decelerates during at least a portion of the immersion process in order to control the electrolyte wetting wavefront.

In certain embodiments, any two or three of the rotation, vertical translation, and tilt of the wafer can be adjusted simultaneously using an appropriate mechanical control system. The adjusting mechanisms may operate on a portion of the wafer holder located outside the vacuum component of the plating cell. A wafer holder spindle or other rotational/tilt/translational component may engage with a vacuum sealed wall or cap on the plating cell through a bellows, vacuum bearing and/or other appropriate interface that maintains vacuum while the wafer translates, tilts, and/or rotates.

Immersion Under Vacuum

In various embodiments disclosed herein, the wafer is immersed under vacuum conditions. Under conventional plating techniques, there is a tradeoff between (1) immersing the wafer quickly and (2) reducing air entrapment. However, the use of a vacuum plating cell allows for a quick immersion without bubble formation, as there is virtually no air to become entrapped under the wafer as it immerses. Because bubbles are significantly less likely to form on the surface of the substrate under vacuum, the embodiments herein allow for a quick immersion time which is on the order of, and in many instances quicker than, the timeframes for additive adsorption (about 100 ms) and nucleation (about 50 ms). The total time for immersion can be important, for example, because during immersion one portion of the wafer is exposed to the electrolyte and another portion is not. Depending on the plating conditions, the thickness of a seed layer, etc., it is often important to immerse the wafer as quickly as possible. The quick immersion time will result in both more uniform plating and more uniform feature fill across a substrate.

When using atmospheric pressure plating cells with angled entry, the immersion time of 300 mm wafers can be less than about 150 ms. The immersion time of 450 mm wafers can be less than about 225 ms. The risk of bubble formation, especially at high entry speeds, is greatly diminished when immersion takes place in a cell where the void space above the plating solution has a low pressure (e.g., a pressure below atmospheric pressure). In some cases, when using a sub-atmospheric pressure plating cell, the immersion time represents no more than about 10% of the total time to fill the smallest feature on the plating substrate (or no more than about 10% of the total time to fill a feature of median size on the plating substrate). As mentioned, the immersion time can be, in certain embodiments, less than about 50 ms, less than about 35 ms, less than about 20 ms, less than about 10 ms, or between about 5-15 ms. These speeds may be appropriate for wafers of 300 mm in diameter and/or wafers of 450 mm in diameter. In certain cases, the substrate's vertical entry speed is between about 200-400 mm/s. The principles described herein allow for a vertical entry speed which is faster than the typical entry speeds used in conventional methods.

In various implementations, a plating cell with plating solution and wafer (or other substrate) is operated under vacuum (e.g., a sub-atmospheric pressure such as below about 100 Torr, between about 30-100 Torr, between about 40-80 Torr, or between about 30-50 Torr). The pressure should be maintained at sub-atmospheric levels at least during wafer immersion. In some embodiments, the pressure is also maintained at sub-atmospheric levels during the initial portion of the plating process (e.g., during at least the first about 0.5% or 1% of the plating time, during the first about 10 ms or 20 ms of plating, or while plating the first about 0.5 or 1 Å of metal). In certain implementations, the pressure is maintained at sub-atmospheric levels until plating ceases.

It may be necessary to periodically expose the plating cell to higher pressures, e.g., ambient pressures, in order to replace wafers, refresh the electroplating solution, etc. In some embodiments, the entire plating process is conducted at sub-atmospheric pressures, and the plating cell is exposed to ambient pressures only when no wafer is plating. If a load lock is employed (discussed in more detail below with reference to FIG. 10), then it may possible to operate the cell without breaking vacuum while replacing a plated wafer with an unplated wafer.

Frequently, the plating cell will be in fluidic communication with other components of an electroplating system. Such other components include a reservoir of plating solution, sources of make up solution for the plating solution, various sensors, filters, and in some implementations degassers for removing dissolved gases from the electroplating solution and/or pre-wetting solution. While the plating cell is operating under sub-atmospheric pressure, other system components in direct fluidic contact with the plating cell should likewise operate under sub-atmospheric pressure. Various embodiments shown in the figures provide mechanisms for maintaining a vacuum on all components in fluidic communication with the plating cell during plating. Other components may remain exposed to atmospheric pressure during plating. These non-vacuum components interface with vacuum components only during specified periods, particularly when the plating cell itself is not exposed to vacuum.

Dissolved Gas Control

In various embodiments, the concentration of one or more gasses in the electroplating solution is controlled by removing substantially all dissolved gases in the electrolyte with a degasser operated under vacuum. If the electroplating solution is not degassed prior to entry into a vacuum plating environment, the solution will tend to effervesce, a condition which is not conducive to producing quality plating. In some embodiments, the concentration of dissolved gasses in the electroplating solution is further controlled by selectively injecting gas back into the degassed electrolyte in a defined concentration for a particular application. The gas or gasses should be added in fairly low concentrations to avoid causing the plating solution to effervesce under vacuum. In certain embodiments, oxygen is added at a concentration in the single digit parts per million or parts per billion level (e.g., below about 10 ppm, or below about 1 ppm). Molecular oxygen is believed to play a role in the activity of the organic plating additive known as accelerator. In some embodiments, the concentration of all or some gases in the electrolyte is decreased to the level in the low ppb range or lower (e.g., outside the level of detection using current tools). This may be accomplished by passing the electrolyte through a degasser operated under vacuum. Degasser and vacuum technology are described in U.S. patent application Ser. Nos. 12/684,787 and 12/684,792, both filed Jan. 8, 2010, which were both previously incorporated by reference in their entireties.

In certain embodiments, it is desirable to have different electroplating solutions in contact with the anode (anolyte) and the cathode (catholyte). The anolyte and catholyte may have different concentrations of the same species (e.g., different concentrations of copper ions), and/or they may have different species present in solution (e.g., organic electroplating additives such as accelerators may be present in the catholyte and absent in the anolyte). As such, some embodiments utilize partially or completely separate flow loops for the catholyte and the anolyte. In this way, the catholyte and anolyte can be separately optimized.

One advantage to at least partially separate flow loops is that the concentration of oxygen may be maintained at different levels in the catholyte and anolyte as delivered to the plating cell. In some implementations, it is desirable for the concentration of oxygen in the catholyte to be 0 ppm, or as close to 0 ppm (or 0 ppb) as possible, while the concentration of oxygen in the anolyte is maintained at a low, non-zero level (e.g., 0.2-2 ppm). Having zero oxygen present in the catholyte is preferable in certain cases because the presence of oxygen increases the likelihood and extent of seed layer dissolution/oxidation during immersion. Having a small amount of oxygen present in the anolyte may be desirable.

A related advantage to having at least partially separate flow loops is that the need for an oxygen servo connected with the catholyte is eliminated. In conventional electroplating, two oxygen servos may be employed: one servo to control the amount of oxygen in the catholyte and one servo to control the amount of oxygen in the anolyte. In the implementations herein, there is no need for a servo to control the amount of oxygen in the catholyte because the degasser/vacuum cell can reduce the level of oxygen in the catholyte to approximately zero ppm.

In some embodiments, it may be desirable to have a small, carefully controlled amount of oxygen in the catholyte. This may be accomplished by, for example, selectively injecting oxygen back into the degassed catholyte in a defined concentration. This may be accomplished by inserting an oxygen injector downstream from a degasser in a fluidic loop that includes a sub-atmospheric electroplating cell. Without wishing to be bound by a particular theory or mechanism of action, it is believed that a small amount of oxygen may facilitate conversion of certain additives into their useful forms (e.g., converting mercaptopropane sulfonic acid (MPS) to dimercaptopropane sulfonic acid (SPS)). The control of dissolved oxygen and its relation to additive performance is further discussed in U.S. patent application Ser. No. 13/229,615, filed Sep. 9, 2011 and titled "By-Product Mitigation in Through-Silicon-Via Plating" and U.S. patent application Ser. No. 13/324,890, filed Dec. 13, 2011 and titled "Configuration and Method of Operation of an Electrodeposition System for Improved Process Stability and Performance," both incorporated herein by reference in their entireties.

The embodiments herein also allow different dissolved gas (e.g., oxygen) concentrations at different locations in the flow loop(s). The concentration of oxygen in electrolyte may vary between, for example, a plating solution holding cell and the electroplating cell. The degasser, vacuum plating cell, electrolyte reservoir and other components (valves, vacuum pump, etc.) work in combination to provide the desired gas content at different parts of the apparatus. Apparatus permitting such control are depicted in FIG. 3, for example.

Figure 3:
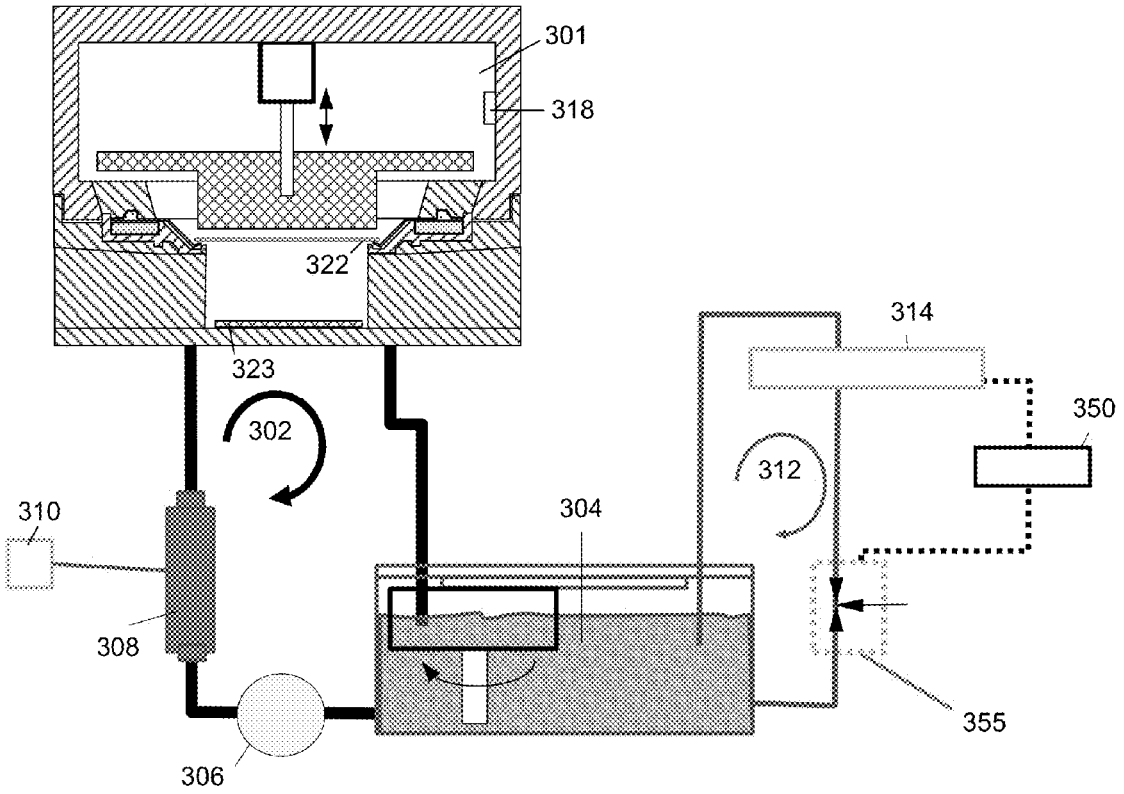
FIG. 3 shows an electroplating system having a plating recirculation loop and a gas control recirculation loop.

FIG. 3 shows an implementation of a vacuum plating cell apparatus with the ability to control dissolved gas content of plating solution. In this embodiment, the vacuum plating cell 301 includes a pressure sensor 318 and is in continuous fluidic communication with a vacuum plating solution reservoir 304, a pump 306 and a degasser 308 in recirculation loop 302. The degasser may be coupled with a vacuum pump 310. The vacuum plating solution reservoir 304 is maintained under vacuum, and is further connected with gas control loop 312. The gas control loop 312 may include a dissolved gas sensor 314, a controller 350, and a gas injection unit 355. The controller 350 may be a servo controller, for example. As mentioned, in certain implementations, it may be desirable to have a specified level of one or more gasses present in the plating solution. The gas control loop 312 allows the amount and species of dissolved gas to be manipulated as desired. First the dissolved gas sensor 314 senses the amount of dissolved gasses present in the plating solution. Next, the controller 350 uses the dissolved gas measurement to determine whether more gas should be injected into the plating solution. If the level of one or more dissolved gasses is too low, the controller 350 will direct the gas injection unit 355 to inject the desired gas into the plating solution. This control loop 312 allows the amount of dissolved gas in the plating solution to be closely monitored and controlled over time. The gas control loop 312 is especially beneficial in these implementations because it is relatively easy to achieve a desired gas content once all or nearly all of the dissolved gasses are removed. The degassed plating solution provides a kind of "blank slate" which is easy to customize by injecting in the desired gasses at their desired concentrations.

The vacuum plating cell 301 of FIG. 3 is shown with no separating structure between the cathode/wafer 322 and the anode 323. Where no separating structure is used, the fluid paths shown correspond to the fluid paths of the electrolyte. There is no separate path for catholyte and anolyte, as these two fluids are the same where no separation structure is used. However, when a membrane or other separation structure is positioned between the wafer 322 and the anode 323, separate fluid loops may be used for the catholyte and anolyte. Unless otherwise stated, the fluid loops disclosed herein may pertain to overall electrolyte fluid loops, catholyte fluid loops, or anolyte fluid loops. For instance, if the electroplating cell 301 of FIG. 3 includes a separating membrane between the wafer 322 and anode 323, then the fluid paths shown may correspond to the fluid path of the catholyte. Similar or identical fluid paths may be provided for the anolyte, as well, though in certain implementations the anolyte fluid paths may be simpler.

In one embodiment, oxygen is provided at a very low level in the sub-atmospheric plating cell and at a slightly higher concentration in a reservoir or other portion of the system outside the sub-atmospheric electroplating cell. In this case, the plating additives may be "reconditioned" in the reservoir. This reservoir-based reconditioning allows the plating cell to be operated at an oxygen concentration level where such reconditioning is not possible, thereby minimizing seed dissolution.

Electrical Power to the Substrate During Entry

Because the wafer enters the electrolyte so quickly, the need for potentiostatic wafer entry may be significantly reduced or eliminated. In many conventional electroplating techniques, a controller or other power supply provides electrical power to the wafer during immersion to help achieve uniform plating. For example, the controller may apply a constant cathodic potential or current to the wafer before and during immersion in order to protect the seed layer from dissolving. This technique is known as potentiostatic wafer entry, and it is further discussed in U.S. Pat. No. 6,946,065, filed Nov. 16, 2000, incorporated herein by reference in its entirety. The potentiostatic entry method requires careful control of the current density applied to the wafer to achieve uniform plating. In conventional potentiostatic entry cases, the control of current density is especially difficult due to the changing wetted wafer area as the substrate is gradually immersed. However, the embodiments presently disclosed significantly reduce or eliminate the need for potentiostatic entry because immersion occurs so quickly that the seed layer does not dissolve during immersion. As such, in certain embodiments, no cathodic or anodic bias is applied to the wafer during immersion. These embodiments are advantageous because electroplating does not occur during immersion. As a consequence, organic plating additive profiles can fully develop in all regions of the substrate surface prior to the initiation of electroplating. This quick entry is also beneficial because one region of the substrate surface does not begin plating prior to any other region of the surface. Further, the electroplating control systems are less sensitive, meaning that they do not require such careful control of current density and other factors that are critical when using potentiostatic wafer entry. Further, these embodiments may use controllers that are less complicated and expensive.

System Controller

In some embodiments, a system controller (which may include one or more physical or logical controllers) controls some or all of the operations of a process tool. The system controller will typically include one or more memory devices and one or more processors. The processor may include a central processing unit (CPU) or computer, analog and/or digital input/output connections, stepper motor controller boards, and other like components. Instructions for implementing appropriate control operations are executed on the processor. These instructions may be stored on the memory devices associated with the controller or they may be provided over a network. In certain embodiments, the system controller executes system control software.

The system control software may include instructions for controlling the timing, mixture of electrolyte components, inlet pressure, plating cell pressure, plating cell temperature, wafer temperature, current and potential applied to the wafer and any other electrodes, wafer position, wafer rotation, wafer immersion speed, and other parameters of a particular process performed by the process tool. System control software may be configured in any suitable way. For example, various process tool component subroutines or control objects may be written to control operation of the process tool components necessary to carry out various process tool processes. System control software may be coded in any suitable computer readable programming language.

In some embodiments, system control software includes input/output control (IOC) sequencing instructions for controlling the various parameters described above. For example, each phase of an electroplating process may include one or more instructions for execution by the system controller. The instructions for setting process conditions for an immersion process phase may be included in a corresponding immersion recipe phase. In some embodiments, the electroplating recipe phases may be sequentially arranged, so that all instructions for a electroplating process phase are executed concurrently with that process phase.

Other computer software and/or programs may be employed in some embodiments. Examples of programs or sections of programs for this purpose include a substrate positioning program, a electrolyte composition control program, a pressure control program, a heater control program, and a potential/current power supply control program.

In some cases, the controllers control one or more of the following functions: gas concentration in the electrolyte, wafer immersion (translation, tilt, rotation), fluid transfer between tanks, and vacuum control of the cell and associated components in the fluid loop. The controller may control the gas concentration by, for example, using a measured gas concentration from a dissolved gas sensor and directing a gas injection unit to inject gas as desired. The wafer immersion may be controlled by, for example, directing the wafer lift assembly, wafer tilt assembly and wafer rotation assembly to move as desired. The controller may control the fluid transfer between tanks by, for example, directing certain valves to be opened or closed and certain pumps to turn on and off. The controllers may control these aspects based on sensor output (e.g., when current, current density, potential, pressure, etc. reach a certain threshold), the timing of an operation (e.g., opening valves at certain times in a process) or based on received instructions from a user.

Applications

The embodiments disclosed herein may provide one or more advantages over conventional plating techniques. First, the vacuum plating cell allows a substrate to immerse in electrolyte very quickly. The high speed immersion may result in significantly less dissolution of the seed layer, and substantially fewer variations/defects in the resulting feature fill. High speed immersion may also reduce the entry transient timeframe such that it is comparable to, and in some cases less than, the transient timeframes for adsorption and nucleation. Further, in some implementations, immersion is conducted without application of an electrical bias on the substrate, thereby avoiding electroplating during the immersion process. Next, the vacuum plating cell reduces the number of defects caused by bubble formation by substantially reducing, and in some cases eliminating, gasses near the face of the wafer during entry. Further, by reducing or eliminating $O_2$ near the face of the wafer during entry, there may be a reduction in corrosion-based defects caused by the $O_2$. Similarly, conducting a pre-wetting operation under vacuum with a degassed pre-wetting fluid may also contribute to reduced corrosion of the seed layer. Embodiments herein also provide for the reduction or elimination of dissolved gasses from the plating solution, one benefit of which is to further reduce the corrosion-related defects caused by $O_2$.

Removing the dissolved gasses from the plating solution provides a convenient way to control the exact amount/composition of dissolved gasses in the solution. After the dissolved gasses are removed to a point of negligible concentration, desired amounts of gasses may be injected into the solution to achieve gas concentration at a preferred electrolyte composition. The control over the dissolved gasses may be enhanced by using a dissolved gas sensor and a servo to maintain the gas concentration(s) within certain ranges.

Certain embodiments herein allow plating to occur in lower temperature regimes than those typically used in conventional plating. For example, some implementations allow plating to occur below the typical freezing temperature of a plating solution at atmospheric pressure conditions. Further, the embodiments herein allow plating to occur at reduced pressures, in some cases down to the boiling point of the plating solution. The low pressure conditions in the plating chamber are continuously maintained in some implementations, such as where a loadlock design is used. In other implementations, the pressure cycles between atmospheric and sub-atmospheric conditions.

The vacuum plating cell may be used in conjunction with various wafer entry control apparatus such as a wafer lift mechanism, a wafer tilt mechanism, a wafer spin mechanism, and various wafer agitations mechanisms including, but not limited to, sonic-based fluid agitation and cyclic directional changes of the rotational axis. Each of these elements may contribute to a reduction in bubble formation, and they may be simultaneously optimized to produce the fewest bubbles possible.

An additional advantage is that, while the wafer is positioned above the plating cell awaiting immersion into the plating solution, it is in vacuum and therefore not being exposed to deleterious gases such as oxygen. This eliminates any copper oxidation reaction that may occur at this stage in an atmospheric plating cell.

In implementations herein, an apparatus for electroplating includes an electrochemical cell capable of operating under vacuum conditions (i.e., less than atmospheric pressure). In many cases, the apparatus includes a degasser capable of substantially degassing the electrolyte and/or pre-wetting solution before it contacts a substrate. If the electrolyte/pre-wetting fluid is not degassed prior to entering the vacuum chamber and contacting the substrate under vacuum conditions, dissolved gas may be released from the fluid as it enters the chamber. This dissolved gas release may result in the formation of bubbles inside the vias and/or on the wafer surface. While not wishing to be limited by a particular model or theory, a via bottom has a negative curvature, and it is believed that this type of location is particularly susceptible to nucleating a bubble and releasing gas from the electrolyte/pre-wetting fluid. If this release occurs, bubbles will be formed from the fluid because the fluid is supersaturated with gas under the vacuum conditions. The bubbles so formed can remain there after the pre-wetting process and during plating, which in turn can inhibit plating at that location and lead to associated defects.

The apparatus may include one or more plating fluid loops which may connect the electrochemical cell with one or more electrolyte reservoirs, pump(s), degasser(s), dissolved gas sensor(s), servo controller(s) or other controller(s), gas injection unit(s), and valve(s). Some or all of the foregoing features may be present in certain embodiments.

Figure 4:
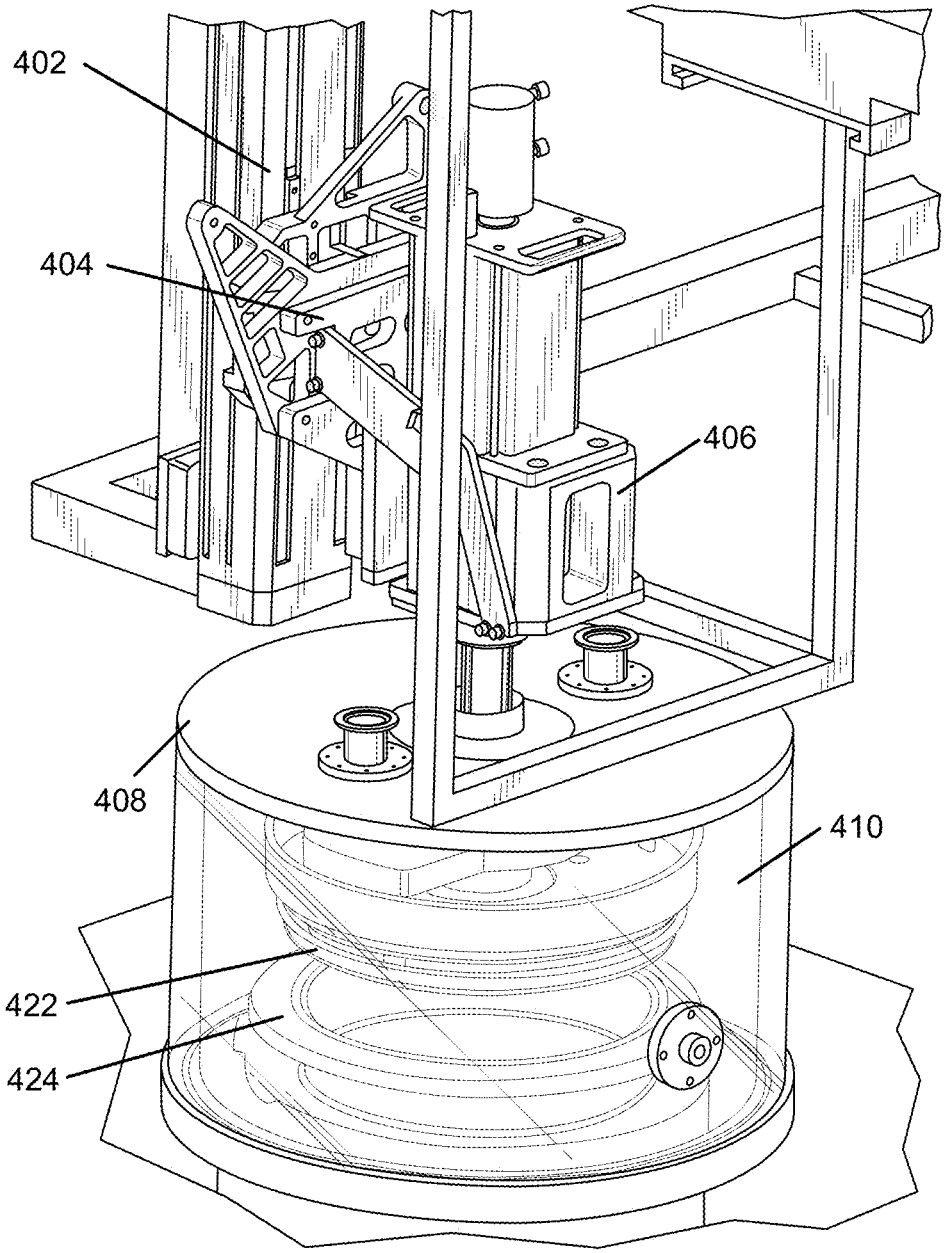
FIG. 4 illustrates a vacuum electroplating cell according to certain embodiments.

FIG. 4 shows an example vacuum plating cell 400. The apparatus includes a wafer lift assembly 402 that operates to move the substrate in the z-direction (up and down), a wafer tilt assembly 404 that operates to tilt the wafer with respect to a horizontal plane, and a wafer rotation assembly 406 that operates to rotate the wafer during electroplating. These elements work together to control the vertical speed, angle and rate of rotation of the wafer during plating, and they are especially important in controlling plating at the beginning of the plating process. Next, the apparatus according to the embodiment in FIG. 4 includes a vacuum compatible plating cell 410 with a corresponding vacuum top plate 408. These elements 410 and 408 provide a vacuum environment in which plating may occur. The electrochemical cell 410 also includes a wafer holder 424 and cone 422. The cone 422 presses down on the backside of a wafer as it is supported in the substrate holder 424. Additional components of the electroplating cell 410 are provided in FIG. 5.

Figure 5:
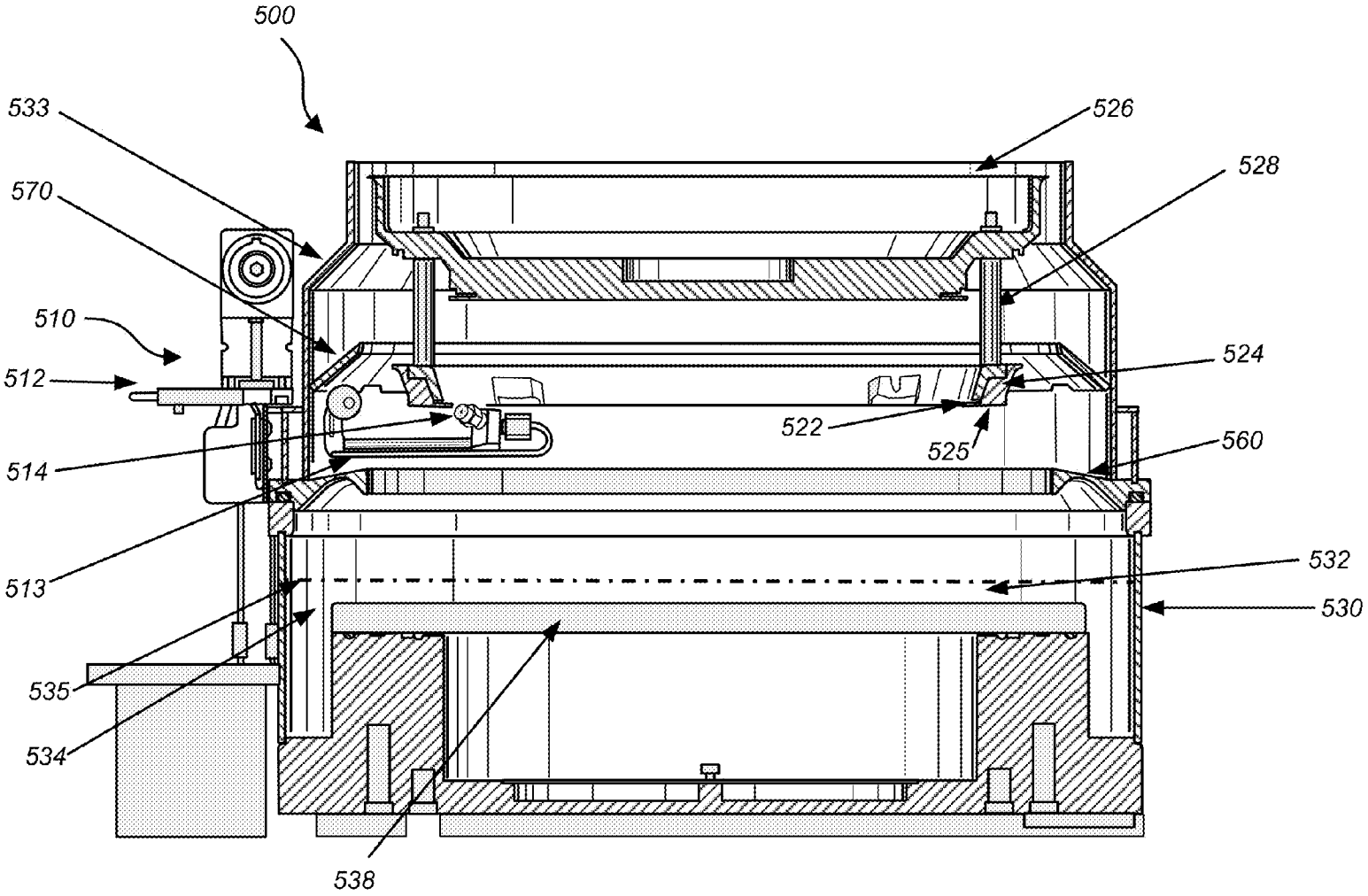
FIG. 5 shows a cross-sectional view of a vacuum electroplating cell according to certain embodiments.

FIG. 5 shows an electroplating apparatus 500 according to one embodiment. To begin, the electroplating apparatus 500 has a substrate holder 520, an electroplating cell 530 with a volume for holding an electroplating bath fluid 534, an anode, and a "tophat" 533 which may enclose the upper portions of the electroplating apparatus (such as, for example, the substrate holder 420 when a substrate is being loaded). The tophat 533 is capable of maintaining a vacuum on the electroplating cell 530, and corresponds to the vacuum top plate 408 of FIG. 4. The substrate holder 520 generally includes a lipseal 522 mounted in a cup 524 having a cup bottom 525, a cone 526 movable relative to the cup 524 and lipseal 522, and is configured to secure a substrate in the substrate holder 520 by pressing the substrate (not shown) into the lipseal 422.

In some embodiments, such as that shown in FIG. 5, cup 524 is supported by cup struts 528 and attached to the cup-and-cone lift (not shown, but resides above the cone 526). The cup struts 528 pass though a portion of the cone 526 allowing the cone to move up-and-down via a pneumatic mechanism (mechanism not shown) relative to cup 524. Thereby the clamshell assembly (or substrate holder) may be closed to seal the substrate (not shown) at its periphery against the lip seal 522. When the cone 526 is in the retracted/up position and therefore the clamshell assembly (or substrate holder) is in an open configuration as shown in FIG. 5, a substrate may be loaded into the clamshell assembly and rested upon the lipseal 522. Once the substrate is resting on lipseal 522, cup struts 528 may be compressed (i.e., moved through the cone 526) so that the cup 524 and cone 526 move towards each other-in order to press the bottom surface of the cone 526 against the back surface of the substrate so that the periphery of the other side of the substrate (i.e., the side to be plated) is pressed against the lipseal 522, forming a fluid-tight seal.

The substrate holder 520 also typically includes a plurality of electrical contacts (not shown in FIG. 5), which supply the substrate with electric charge via a power supply of the electroplating apparatus (also not shown) during an electroplating operation. In some embodiments, the electrical contacts are formed as electrical contact fingers, but other shapes/types of electrical leads are also possible for supplying electrical current to the substrate. As indicated above, during plating the electrical contacts are generally protected by the fluid-tight seal formed between the substrate and the lipseal 522 which keeps electroplating solution off of the backside of the substrate and away from the electrical contacts during electroplating. In some embodiment, the nozzle 514 is used to perform cleaning of the electrical contacts, for example by changing the height of the nozzle relative to the electrical contacts and adjusting the flow of cleaning fluid, substrate holder rotation rate, cleaning solution chemistry, and other parameters as appropriate.

Once a substrate is loaded and sealed in the substrate holder (i.e., engaged by the cup 524 and cone 526 and sealed against the lipseal 522), the proximal end of the substrate holder (or clamshell assembly) is ready to be lowered into the electroplating bath (assuming angled immersion is used). The electroplating bath comprises an electrolyte solution contained in the electroplating cell 530 of the electroplating apparatus 500 which holds (or has a volume for holding) the electroplating bath fluid 534. In some embodiments, the electroplating cell 530 may include an anode chamber and cathode chamber separated by a membrane or other separation structure. Further, the cell 530 may include a channeled ionically resistive plate, also sometimes referred to as a high resistance virtual anode (HRVA), which acts as a current distribution controller and flow diffuser 438, as described in U.S. Pat. Nos. 7,967,969, 7,622,024, and 8,308,931, each hereby incorporated by reference in their entirety for all purposes.

During an electroplating operation, the substrate holder 520 is lowered into the electroplating cell's volume 532 for holding the electroplating bath fluid 534 such that the working surface of the substrate (the downward surface) is lowered below the fluid level 535 of the electroplating bath fluid/solution 534, thereby submerging the working surface of the wafer in electroplating solution.

The electroplating apparatus 500 may optionally include cleaning apparatus 510, which may include a nozzle 514, a cleaning fluid supply conduit in fluidic connection with the nozzle 514, and a nozzle arm 513 to which the nozzle 514 is affixed. In some embodiments, the cleaning apparatus 510 includes a nozzle arm actuator 512 mechanically coupled to the nozzle arm 513 and configured to move the first nozzle 514 and nozzle arm 513 between a retracted position and a cleaning position. A rinse shield 570 may be used to help protect the apparatus components from a spray of cleaning solution. A reclaim shield 560 may be used to help reclaim cleaning solution that is used. In certain embodiments, a pre-wetting mechanism (not shown) may be used to pre-wet a plating face of a substrate. A pre-wetting mechanism may be mechanically similar to the cleaning apparatus 510, though it would be positioned such that the pre-wetting fluid contacts the plating face of the substrate. In certain cases, pre-wetting may occur outside of the electroplating cell 530.

Figure 6:
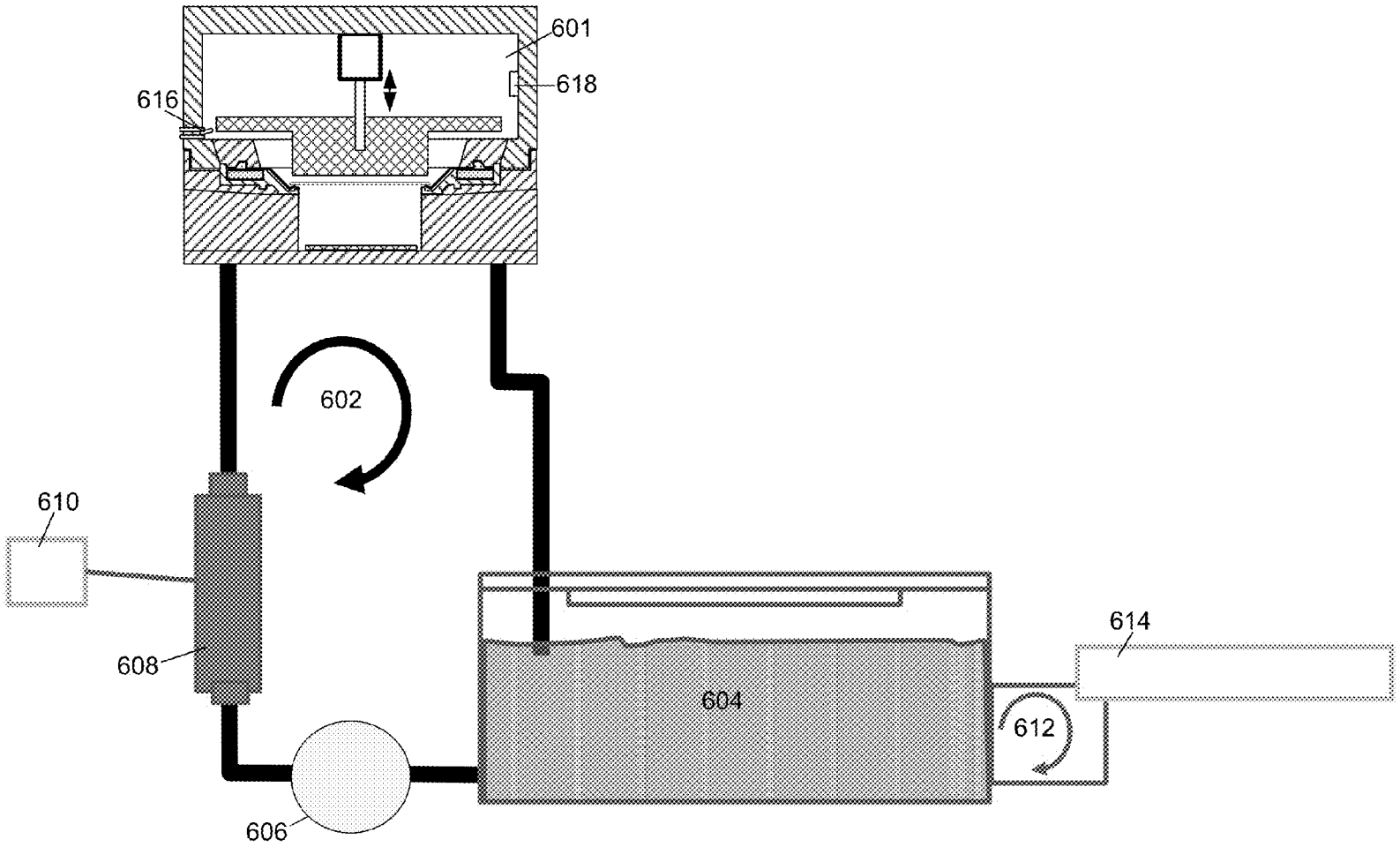
FIG. 6 depicts an electroplating system according to various embodiments.

FIG. 6 shows an additional example of a vacuum plating cell 601 in fluidic communication with a plating fluid reservoir 604. This embodiment is similar to the one shown in FIG. 3, but is somewhat simpler. The area inside the vacuum plating cell 601 is maintained under vacuum conditions. The apparatus includes a degasser 608 for removing dissolved gas from the plating solution, and a pump 606 to move the plating fluid through the plating fluid loop 602. Degassers and their use are described in U.S. patent application Ser. Nos. 12/684,787 and 12/684,792, previously incorporated by reference. The plating fluid loop 602 connects the vacuum plating cell 601 with the plating fluid reservoir 604, the pump 606 and the degasser 608. There may be a vacuum pump 610 connected with the degasser. In the implementation of FIG. 6, the entire plating fluid loop is kept under vacuum conditions, including the plating solution reservoir 604.

In the implementations herein, anything that is in open fluidic communication with the vacuum plating cell during plating should be kept under vacuum conditions during plating to ensure that the pressure in the vacuum plating cell is properly controlled. A fluid sensing loop 612 connects the plating fluid reservoir 604 with a dissolved gas sensor 614. The dissolved gas sensor ensures that the dissolved gasses are at an acceptable level for plating. If the level of dissolved gasses is too high, it may result in the formation of bubbles in the plating solution which leads to non-uniform plating. Additionally, the presence of dissolved oxygen can be harmful to the plating process because oxygen oxidizes the copper seed layer. Thus, in some embodiments, the dissolved gas sensor 614 is an oxygen sensor. The vacuum plating cell 601 may also include a pressure sensor 618. One possible type of pressure sensor that may be used is a Baratron pressure transducer, though one of skill in the art would recognize that many types of pressure sensors may be used. The apparatus may optionally include a pre-wetter 616 that operates to provide degassed deionized water or other pre-wetting solution to the surface of the substrate, under vacuum, before immersion in the plating fluid. The pre-wetter may further decrease the immersion time required to fully immerse the substrate in plating fluid without bubble formation. Because the substrate is shown in the plating position (i.e., the down position, lowered into electrolyte), the pre-wetter is above the plane of the wafer. However, it is understood that the pre-wetter should be positioned such that it is able to apply pre-wetting solution to the plating face of a substrate when the substrate is in its non-plating position.

Figure 7:
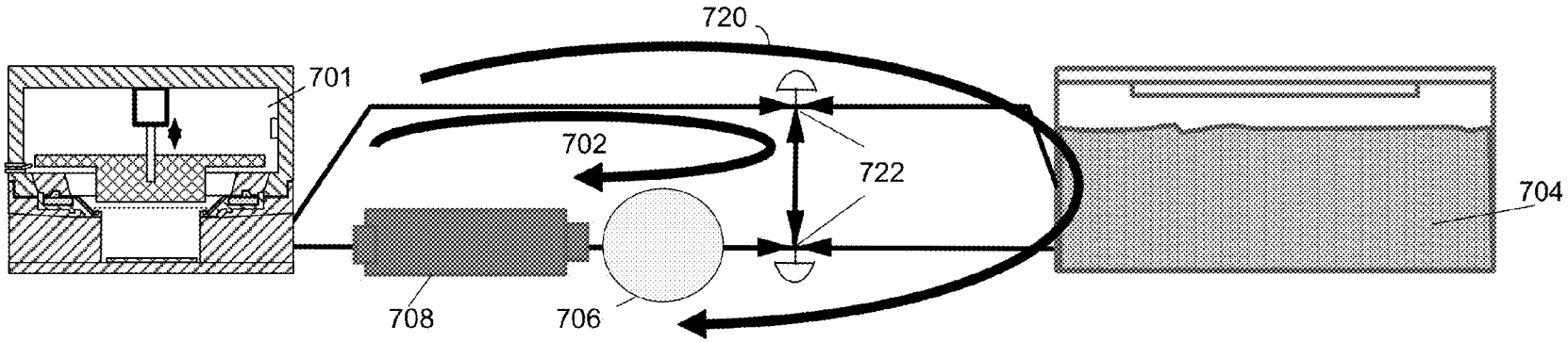
FIG. 7 shows an electroplating system having a bypass conduit.

FIG. 7 shows an additional embodiment of a vacuum plating cell 701 in fluidic communication with a plating solution reservoir 704. In this implementation, plating loop 702 is open during plating, and connects the vacuum plating cell 701 with pump 706 and degasser 708. The electrolyte bypasses the electrolyte reservoir during plating, instead passing through a conduit connecting the valves 722. Each of these elements is maintained under vacuum conditions. Valves 722 may be opened when plating is not occurring, thereby opening non-plating fluid loop 720. The non-plating fluid loop 720 connects the vacuum plating cell 701 with a plating solution reservoir 704, the pump 706 and the degasser 708. In this implementation, the plating solution reservoir 704 is kept at atmospheric conditions. Thus, it must be fluidically separate from the vacuum plating cell during plating. The plating solution in the plating solution reservoir 704 should be periodically changed or refreshed in order to maintain adequate levels of additives in the plating solution. The level of dissolved gasses in the plating solution in the implementation of FIG. 7 is about 2 ppm, which corresponds to the level of dissolved gasses achievable after a single pass through presently available degassers.

Figure 8:
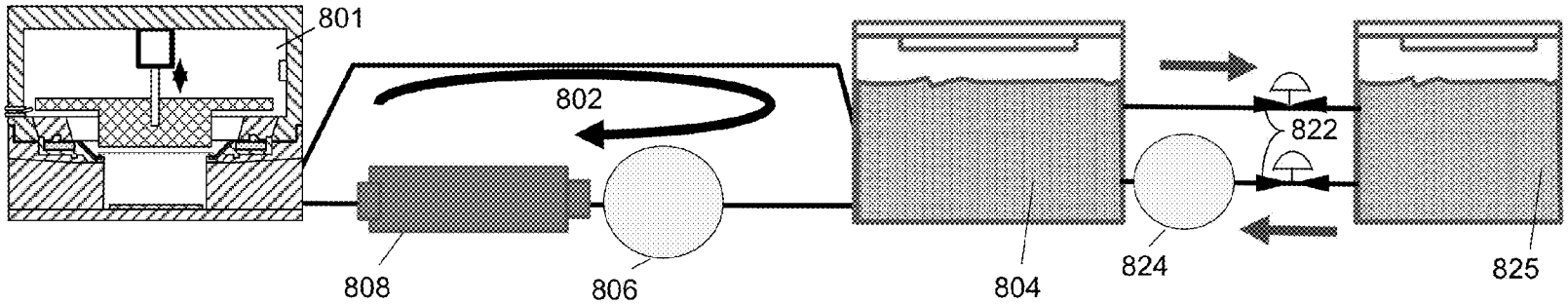
FIG. 8 illustrates an electroplating system having two electrolyte reservoirs and two recirculation loops.

FIG. 8 shows an implementation of a vacuum plating cell 801 with a dual reservoir system. In this embodiment, the vacuum plating cell 801 is in continuous fluidic communication with a vacuum plating solution reservoir 804, pump 806 and degasser 808. The vacuum plating solution reservoir 804 is maintained under vacuum conditions, and it is in fluid communication with an atmospheric plating solution reservoir 825, valves 822 and a pump 824. The fluid loop connected to the atmospheric plating solution reservoir 825 may be opened when plating is not occurring, but should be closed when plating is occurring. The atmospheric plating solution reservoir 825 may be used to provide fresh plating fluid to the vacuum plating solution reservoir 804 between electroplating runs. The level of dissolved gasses in the plating solution in the plating cell 801 may be less than about 1 ppm. Having dual reservoirs with one reservoir under vacuum conditions substantially reduces the amount of dissolved gas in the plating fluid and provides additional control of plating fluid constituents.

Figure 9:
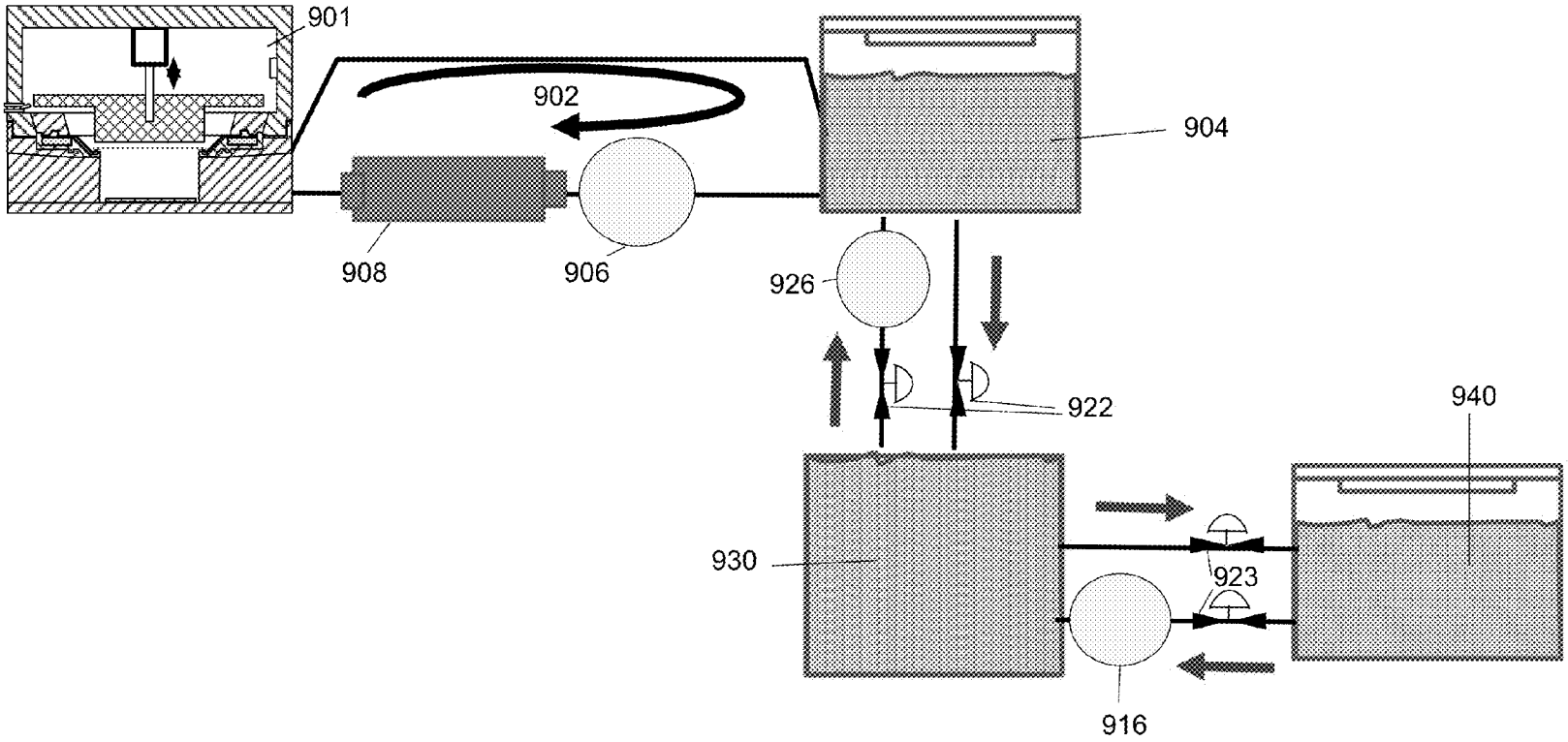
FIG. 9 shows an electroplating system having three electrolyte reservoirs and three recirculation loops.

FIG. 9 shows an implementation of a vacuum plating cell 901 with a triple reservoir system. In this embodiment, the vacuum plating cell 901 is in continuous fluidic communication with a vacuum plating solution reservoir 904, pump 906 and degasser 908. The vacuum plating solution reservoir 904 is maintained under vacuum conditions, and is further connected with a vacuum degassing bath 930, pump 926, and valves 922. Valves 922 are closed during plating such that the vacuum plating solution reservoir 904 and the vacuum degassing bath 930 are not in fluidic communication when plating is occurring. When plating is not occurring, however, the valves 922 may be opened and plating solution may flow between the vacuum plating solution reservoir 904 and the vacuum degassing bath 930. An atmospheric plating solution reservoir 940 may be in periodic fluid communication with the vacuum degassing bath 930. A pump 916 may be provided such that when the valves 923 are opened, plating solution flows between the vacuum degassing bath 930 and the atmospheric plating bath 940. The valves 923 should be opened periodically to refresh or exchange the plating solution and ensure that the concentration of additives or other plating solution components remain within their desired ranges. The set of valves 922 between the vacuum plating solution reservoir 904 and the vacuum degassing bath 930 should not be open at the same time as the set of valves 923 between the vacuum degassing bath 930 and the atmospheric plating solution reservoir 940. This will allow the vacuum plating cell 901 to remain under vacuum conditions at all times. The dissolved gasses in the plating solution in this implementation may be controlled to a level significantly less than 1 ppm, for example.

Figure 10:
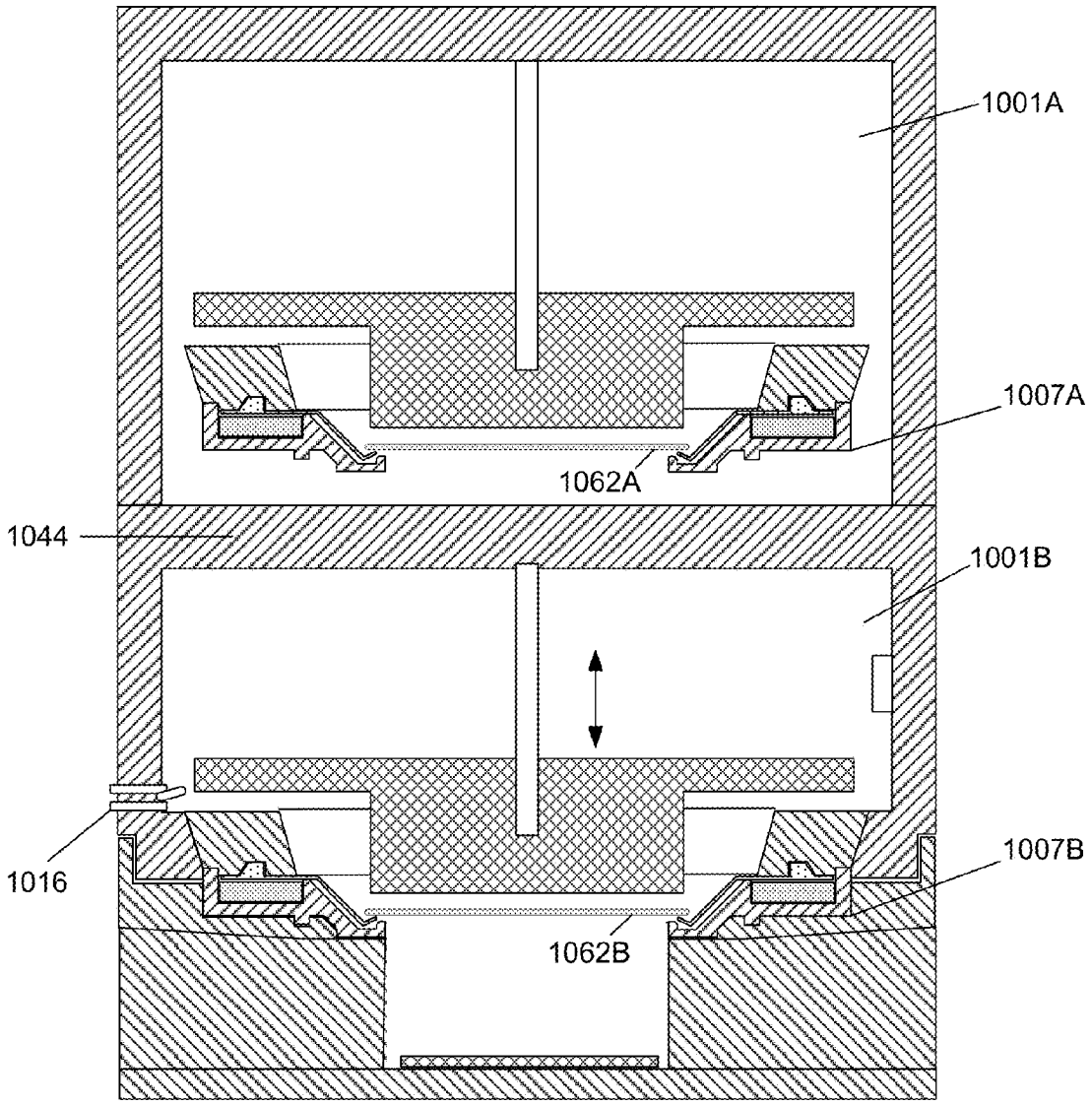
FIG. 10 illustrates an electroplating cell having a load-lock.

FIG. 10 shows an embodiment of a vacuum plating cell outfitted with a loadlock apparatus. The loadlock apparatus allows the cell to operate without breaking vacuum when replacing a plated wafer with an unplated wafer. FIG. 10 shows the vacuum plating cell in two different positions (i.e., although the figure shows two wafers 1062A and 1062B and associated wafer holders 1007A and 1007B, the two wafers are intended to represent a single wafer 1062 and holder 1007 in two different positions A and B). When the wafer is in the vacuum loadlock position in the non-vacuum portion of the apparatus 1001A, the plating cell is sealed off under vacuum conditions and the wafer 1062 may be loaded. The vacuum loadlock is then pumped down to vacuum conditions, and a slit valve (not shown) or other appropriate valve in the vacuum-atmosphere interface 1044 is opened. The wafer 1062 then passes into the vacuum plating cell position in the vacuum portion of the apparatus 1001B, which is maintained under vacuum, and plating may occur.

FIG. 11 shows results for a study that was conducted to ensure that low pressure plating can be successful. The two questions explored in the study were (1) whether the non-aqueous components of the plating fluid would evaporate in significant amounts at low pressure, and (2) whether the plating fluid would boil at pressures significantly higher than the anticipated boiling point for water. These questions are important because plating may fail if non-aqueous components evaporate under vacuum pressure, or if the plating solution starts to boil during plating. In order to explore these issues, a plating solution and a solution of deionized water were exposed to a range of pressures between atmospheric and vacuum conditions (specifically 10, 20, 40 and 760 Torr). At each pressure, the samples were observed for signs of boiling, and a gas sample was extracted from above the plating solution and analyzed in a residual gas analyzer. Boiling was observed at 10 Torr for both the water and the plating solution, and both solutions boiled intermittently at 20 Torr. No boiling was observed at 40 or 760 Torr in either solution. This suggests that plating should occur above at least about 20 Torr. There were no significant differences between the RGA analysis of the deionized water and the RGA analysis of the plating solution at any pressure tested. This suggests that the non-aqueous components of the plating fluid do not evaporate in significant amounts, making low-pressure plating a viable option.

One aspect of the disclosure concerns an electroplating apparatus containing an electroplating cell connected to a mechanism for reducing the pressure in the electroplating cell to a sub-atmospheric level. The apparatus also includes a controller for causing the pressure in the electroplating cell to be sub-atmospheric during immersion of an electroplating substrate into the electroplating solution. The apparatus may include various other features such as recirculation loops having reservoirs, degassers, pumps, and the like as depicted in the figures. These loops may be selectively isolated from or included in the sub-atmospheric environment of the electroplating cell as desired. In some cases, the apparatus is configured to conduct substrate immersion at a pressure of about 100 Torr or less. In some cases, the apparatus is configured to conduct substrate immersion over a duration of about 50 ms or less, or about 35 ms or less, or about 25 ms or less, or about 15 ms or less. In some cases, the apparatus is configured to conduct substrate immersion over a duration that represents no more than about 10% of the total time required to fully electrofill an average or median-sized feature on the substrate plating surface.

Figure 12:
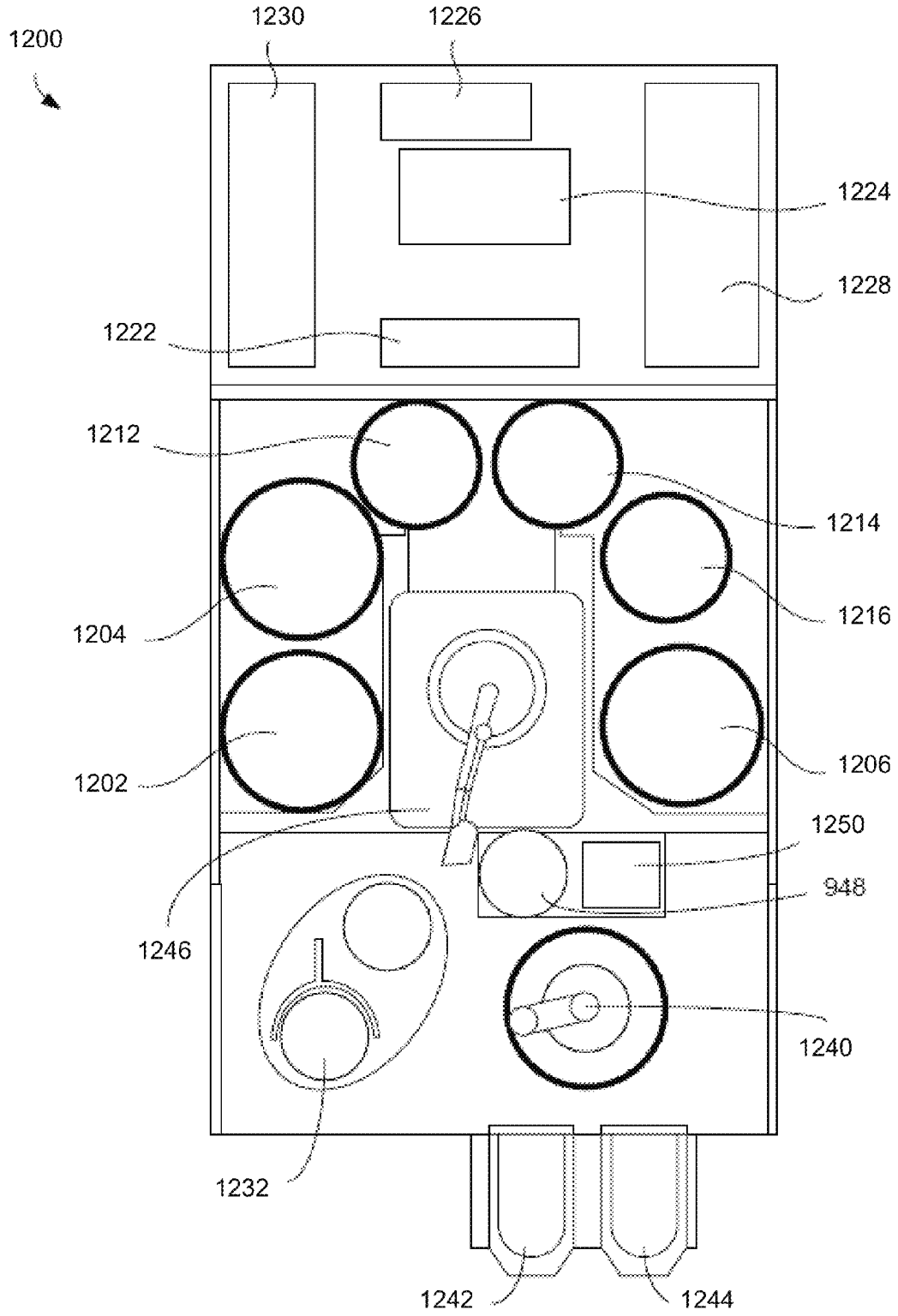
FIGS. 12 and 13 depict alternative embodiments of a multi-tool electroplating apparatus according to certain embodiments.

A vacuum electroplating cell may be integrated into a multi-tool semiconductor processing apparatus. The multi-tool apparatus may have one or more vacuum plating cells, one or more atmospheric plating cells, and a variety of other elements. FIG. 12 shows an example multi-tool apparatus that may be used to implement the embodiments herein. The electrodeposition apparatus 1200 can include three separate electroplating modules 1202, 1204, and 1206. Further, three separate modules 1212, 1214 and 1216 may be configured for various process operations. For example, in some embodiments, one or more of modules 1212, 1214 and 1216 may be a spin rinse drying (SRD) module. In other embodiments, one or more of the modules 1212, 1214 and 1216 may be post-electrofill modules (PEMs), each configured to perform a function, such as edge bevel removal, backside etching, and acid cleaning of substrates after they have been processed by one of the electroplating modules 1202, 1204, and 1206.

The electrodeposition apparatus 1200 includes a central electrodeposition chamber 1224. The central electrodeposition chamber 1224 is a chamber that holds the chemical solution used as the electroplating solution in the electroplating modules 1202, 1204, and 1206. The electrodeposition apparatus 1200 also includes a dosing system 1226 that may store and deliver additives for the electroplating solution. A chemical dilution module 1222 may store and mix chemicals to be used as an etchant. A filtration and pumping unit 1228 may filter the electroplating solution for the central electrodeposition chamber 1224 and pump it to the electroplating modules.

A system controller 1230 provides electronic and interface controls required to operate the electrodeposition apparatus 1200. The system controller 1230 is introduced above in the System Controller section, and is described further herein. The system controller 1230 (which may include one or more physical or logical controllers) controls some or all of the properties of the electroplating apparatus 1200. The system controller 1230 typically includes one or more memory devices and one or more processors. The processor may include a central processing unit (CPU) or computer, analog and/or digital input/output connections, stepper motor controller boards, and other like components. Instructions for implementing appropriate control operations as described herein may be executed on the processor. These instructions may be stored on the memory devices associated with the system controller 1230 or they may be provided over a network. In certain embodiments, the system controller 1230 executes system control software.

The system control software in the electrodeposition apparatus 1200 may include instructions for controlling the timing, mixture of electrolyte components (including the concentration of one or more electrolyte components), electrolyte gas concentrations, inlet pressure, plating cell pressure, plating cell temperature, substrate temperature, current and potential applied to the substrate and any other electrodes, substrate position, substrate rotation, and other parameters of a particular process performed by the electrodeposition apparatus 1200.

System control logic may be configured in any suitable way. For example, various process tool component subroutines or control objects may be written to control operation of the process tool components necessary to carry out various process tool processes. System control software may be coded in any suitable computer readable programming language. The logic may also be implemented as hardware in a programmable logic device (e.g., an FPGA), an ASIC, or other appropriate vehicle.

In some embodiments, system control logic includes input/output control (IOC) sequencing instructions for controlling the various parameters described above. For example, each phase of an electroplating process may include one or more instructions for execution by the system controller 1230. The instructions for setting process conditions for an immersion process phase may be included in a corresponding immersion recipe phase. In some embodiments, the electroplating recipe phases may be sequentially arranged, so that all instructions for an electroplating process phase are executed concurrently with that process phase.

The control logic may be divided into various components such as programs or sections of programs in some embodiments. Examples of logic components for this purpose include a substrate positioning component, an electrolyte composition control component, a stripping solution composition control component, a solution flow control component, a pressure control component, a heater control component, and a potential/current power supply control component. The controller may execute the substrate positioning component by, for example, directing the substrate holder to move (rotate, lift, tilt) as desired. The controller may control the composition and flow of various fluids (including but not limited to electrolyte and stripping solution) by directing certain valves to open and close at various times during processing. The controller may execute the pressure control program by directing certain valves, pumps and/or seals to be open/on or closed/off. Similarly, the controller may execute the temperature control program by, for example, directing one or more heating and/or cooling elements to turn on or off. The controller may control the power supply by directing the power supply to provide desired levels of current/potential throughout processing.

In some embodiments, there may be a user interface associated with the system controller 1230. The user interface may include a display screen, graphical software displays of the apparatus and/or process conditions, and user input devices such as pointing devices, keyboards, touch screens, microphones, etc.

In some embodiments, parameters adjusted by the system controller 1230 may relate to process conditions. Non-limiting examples include solution conditions (temperature, composition, and flow rate), substrate position (rotation rate, linear (vertical) speed, angle from horizontal) at various stages, etc. These parameters may be provided to the user in the form of a recipe, which may be entered utilizing the user interface.

Signals for monitoring the process may be provided by analog and/or digital input connections of the system controller 1230 from various process tool sensors. The signals for controlling the process may be output on the analog and digital output connections of the process tool. Non-limiting examples of process tool sensors that may be monitored include mass flow controllers, pressure sensors (such as manometers), thermocouples, optical position sensors, etc. Appropriately programmed feedback and control algorithms may be used with data from these sensors to maintain process conditions.

In one embodiment of a multi-tool apparatus, the instructions can include inserting the substrate in a wafer holder, tilting the substrate, biasing the substrate during immersion, and electrodepositing a copper containing structure on a substrate. The instructions may further include transferring the substrate to a removal cell, immersing the substrate in stripping solution, rotating the substrate, flowing stripping solution from an internal cross flow manifold and across the face of the wafer (including adjusting the flow rate, total or a portion thereof), and removing, rinsing and drying the substrate.

A hand-off tool 1240 may select a substrate from a substrate cassette such as the cassette 1242 or the cassette 1244. The cassettes 1242 or 1244 may be front opening unified pods (FOUPs). A FOUP is an enclosure designed to hold substrates securely and safely in a controlled environment and to allow the substrates to be removed for processing or measurement by tools equipped with appropriate load ports and robotic handling systems. The hand-off tool 940 may hold the substrate using a vacuum attachment or some other attaching mechanism.

The hand-off tool 1240 may interface with a wafer handling station 1232, the cassettes 1242 or 1244, a transfer station 1250, or an aligner 1248. From the transfer station 1250, a hand-off tool 1246 may gain access to the substrate. The transfer station 1250 may be a slot or a position from and to which hand-off tools 1240 and 1246 may pass substrates without going through the aligner 1248. In some embodiments, however, to ensure that a substrate is properly aligned on the hand-off tool 1246 for precision delivery to an electroplating module, the hand-off tool 1246 may align the substrate with an aligner 1248. The hand-off tool 1246 may also deliver a substrate to one of the electroplating modules 1202, 1204, or 1206, or to one of the separate modules 1212, 1214 and 1216 configured for various process operations.

An apparatus configured to allow efficient cycling of substrates through sequential plating, rinsing, drying, and PEM process operations (such as stripping) may be useful for implementations for use in a manufacturing environment. To accomplish this, the module 1212 can be configured as a spin rinse dryer and an edge bevel removal chamber. With such a module 1212, the substrate would only need to be transported between the electroplating module 1204 and the module 1212 for the copper plating and EBR operations. One or more internal portions of the apparatus 1200 may be under sub-atmospheric conditions. For instance, in some embodiments, the entire area enclosing the plating cells 1202, 1204 and 1206 and the PEMs 1212, 1214 and 1216 may be under vacuum. In other embodiments, an area enclosing only the plating cells is under vacuum. In further implementations, the individual plating cells may be under vacuum. While electrolyte flow loops are not shown in FIG. 12 or 13, it is understood that the flow loops described herein may be implemented as part of (or in conjunction with) a multi-tool apparatus.

Figure 13:
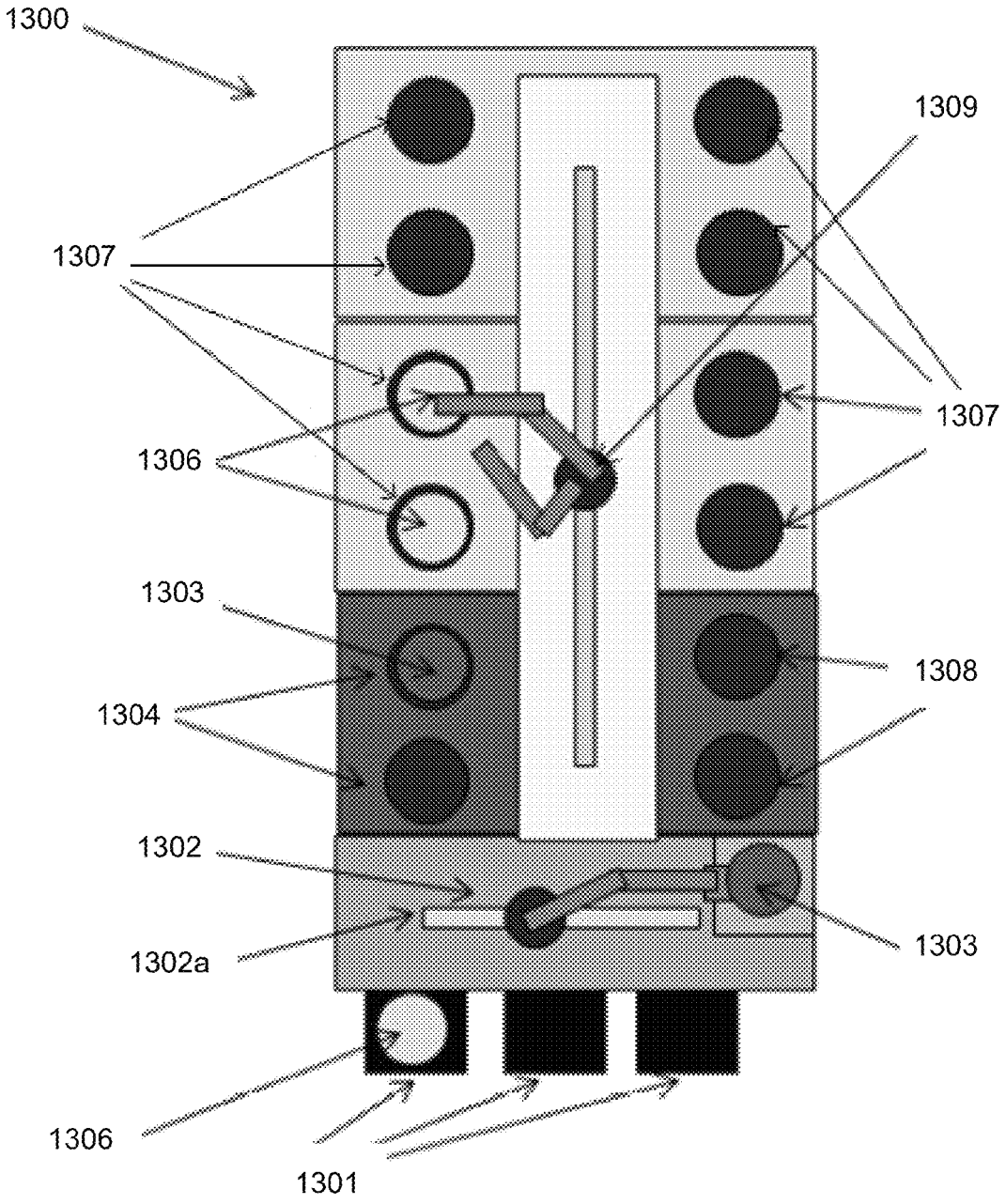

FIG. 13 shows an additional example of a multi-tool apparatus that may be used in implementing the embodiments herein. In this embodiment, the electrodeposition apparatus 1300 has a set of electroplating cells 1307, each containing an electroplating bath, in a paired or multiple "duet" configuration. In addition to electroplating per se, the electrodeposition apparatus 1300 may perform a variety of other electroplating related processes and sub-steps, such as spin-rinsing, spin-drying, metal and silicon wet etching, electroless deposition, pre-wetting and pre-chemical treating, reducing, annealing, photoresist stripping, and surface pre-activation, for example. The electrodeposition apparatus 1300 is shown schematically looking top down, and only a single level or "floor" is revealed in the figure, but it is to be readily understood by one having ordinary skill in the art that such an apparatus, e.g., the Sabre™ 3D tool of Lam Research Corporation of Fremont, Calif. can have two or more levels "stacked" on top of each other, each potentially having identical or different types of processing stations.

Referring once again to FIG. 13, the substrates 1306 that are to be electroplated are generally fed to the electrodeposition apparatus 1300 through a front end loading FOUP 1301 and, in this example, are brought from the FOUP to the main substrate processing area of the electrodeposition apparatus 1300 via a front-end robot 1302 that can retract and move a substrate 1306 driven by a spindle 1303 in multiple dimensions from one station to another of the accessible stations—two front-end accessible stations 1304 and also two front-end accessible stations 1308 are shown in this example. The front-end accessible stations 1304 and 1308 may include, for example, pre-treatment stations, and spin rinse drying (SRD) stations. These stations 1304 and 1308 may also be removal stations as described herein. Lateral movement from side-to-side of the front-end robot 1302 is accomplished utilizing robot track 1302*a*. Each of the substrates 1306 may be held by a cup/cone assembly (not shown) driven by a spindle 1303 connected to a motor (not shown), and the motor may be attached to a mounting bracket 1309. Also shown in this example are the four "duets" of electroplating cells 1307, for a total of eight electroplating cells 1307. The electroplating cells 1307 may be used for electroplating copper for the copper containing structure and electroplating solder material for the solder structure (among other possible materials). A system controller (not shown) may be coupled to the electrodeposition apparatus 1300 to control some or all of the properties of the electrodeposition apparatus 1300. The system controller may be programmed or otherwise configured to execute instructions according to processes described earlier herein.

The various hardware and method embodiments described above may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility.

The electroplating apparatus/methods described hereinabove may be used in conjunction with lithographic patterning tools or processes, for example, for the fabrication or manufacture of semiconductor devices, displays, LEDs, photovoltaic panels and the like. Generally, though not necessarily, such tools/processes will be used or conducted together in a common fabrication facility. Lithographic patterning of a film generally comprises some or all of the following steps, each step enabled with a number of possible tools: (1) application of photoresist on a work piece, i.e., a substrate, using a spin-on or spray-on tool; (2) curing of photoresist using a hot plate or furnace or UV curing tool; (3) exposing the photoresist to visible, UV, or x-ray light with a tool such as a wafer stepper; (4) developing the resist so as to selectively remove resist and thereby pattern it using a tool such as a wet bench; (5) transferring the resist pattern into an underlying film or work piece by using a dry or plasma-assisted etching tool; and (6) removing the resist using a tool such as an RF or microwave plasma resist stripper.

What is claimed is:

1. A method of electroplating metal onto a substrate, comprising:

flowing an electrolyte through a plating recirculation loop comprising an electrolyte reservoir, a pump, an electroplating cell, and a degasser that degasses the electrolyte prior to its introduction to the electroplating cell;

injecting a gas into the electrolyte after the electrolyte is degassed and before the electrolyte is introduced to the electroplating cell;

immersing the substrate in the electrolyte in the electroplating cell, wherein the pressure in the electroplating cell during immersion is about 100 Torr or less;

electroplating material onto the substrate; and removing the substrate from the electrolyte.

2. The method of claim 1, wherein the pressure in the electroplating cell during immersion is at least about 20 Torr.

3. The method of claim 1, wherein the step of immersing the substrate in the electrolyte occurs over a period of about 225 ms or less, and wherein the substrate has a diameter of about 150 mm or greater.

4. The method of claim 3, wherein the step of immersing the substrate in the electrolyte occurs over a period of about 50 ms or less, and wherein the substrate has a diameter of about 150 mm or greater.

5. The method of claim 1, wherein the step of immersing the substrate in the electrolyte occurs over a period having a first duration, and a step of electroplating material to fill a feature on the substrate during the step of electroplating material onto the substrate occurs over a period having a second duration, and wherein the first duration is about 10% or less of the second duration.

6. The method of claim 5, wherein the feature is a smallest feature on the substrate, as measured by volume.

7. The method of claim 5, wherein the feature is a median-sized feature on the substrate, as measured by volume.

8. The method of claim 1, wherein the substrate is immersed at an angle, and wherein the substrate swings to a horizontal orientation at a swing speed between about 0.25-10 degrees/second.

9. The method of claim 1, wherein the pressure in the electroplating cell remains at or below about 100 Torr during at least the first about 10 ms of the electroplating.

10. The method of claim 9, wherein the pressure in the electroplating cell remains at or below about 100 Torr until after the electroplating ceases.

11. The method of claim 1, further comprising inserting the substrate into a loadlock and reducing pressure in the loadlock to below about 100 Torr.

12. The method of claim 1, wherein the gas is oxygen and the oxygen is injected to an electrolyte concentration of about 10 ppm or less.

13. The method of claim 12, wherein the oxygen is injected to an electrolyte concentration of about 1 ppm or less.

14. The method of claim 1, further comprising flowing the electrolyte through a gas control recirculation loop comprising the electrolyte reservoir and a dissolved gas sensor, wherein a dissolved gas controller controls a gas injection unit based on input from the dissolved gas sensor in order to regulate a concentration of dissolved gas in the electrolyte.

15. The method of claim 14, wherein the plating recirculation loop is separate from the gas control recirculation loop.

16. The method of claim 1, wherein during the electroplating, the electrolyte bypasses the electrolyte reservoir of the plating recirculation loop by passing through a bypass conduit.

17. The method of claim 1, further comprising flowing the electrolyte through an atmospheric recirculation loop when the electroplating is not occurring, wherein the atmospheric recirculation loop comprises the electrolyte reservoir, an atmospheric electrolyte reservoir, and an atmospheric loop pump.

18. The method of claim 1, further comprising degassing the electrolyte in a degassing electrolyte reservoir, and flowing the electrolyte through a degassing recirculation loop and an atmospheric recirculation loop, wherein the degassing recirculation loop comprises the electrolyte reservoir, a degassing loop pump, and a degassing electrolyte reservoir, and wherein the atmospheric recirculation loop comprises the degassing electrolyte reservoir, an atmospheric loop pump, and an atmospheric electrolyte reservoir.

19. A method of electroplating metal onto a substrate, comprising:

flowing an electrolyte through a plating recirculation loop comprising an electrolyte reservoir, a pump, an electroplating cell, and a degasser that degasses the electrolyte prior to its introduction to the electroplating cell;

immersing the substrate in the electrolyte in the electroplating cell, wherein the pressure in the electroplating cell during immersion is about 100 Torr or less;

electroplating material onto the substrate, wherein during the electroplating, the electrolyte bypasses the electrolyte reservoir of the plating recirculation loop by passing through a bypass conduit; and removing the substrate from the electrolyte.

20. An apparatus for electroplating metal onto a substrate, comprising:

an electroplating cell configured to withstand pressure below about 100 Torr, comprising a substrate holder, an electrolyte containment vessel, and a substrate positioning system capable of controlling an orientation of a substrate as it is immersed in the electrolyte containment vessel;

a plating recirculation loop comprising an electrolyte reservoir, a pump, a degasser, and the electroplating cell, wherein the degasser is positioned after the electrolyte reservoir and before the electroplating cell in the plating recirculation loop;

a gas injection unit; and a plating controller having instructions for:

flowing an electrolyte through the plating recirculation loop, injecting gas from the gas injection unit into the electrolyte after the electrolyte is degassed and before the electrolyte is introduced to the electroplating cell, immersing the substrate in the electrolyte in the electrolyte containment vessel while maintaining a pressure of about 100 Torr or less in the electrolyte containment vessel, electroplating material onto the substrate, and removing the substrate from the electrolyte.

21. The apparatus of claim 20, wherein the substrate positioning system is capable of controlling translation, tilt and rotation of the substrate.

22. The apparatus of claim 20, further comprising a dissolved gas sensor.

23. The apparatus of claim 22, further comprising a dissolved gas controller, wherein the dissolved gas controller controls the gas injection unit based on measurements from the dissolved gas sensor.

24. The apparatus of claim 20, further comprising a bypass conduit, wherein the plating controller is configured to flow electrolyte through the bypass conduit to thereby bypass the electrolyte reservoir during electroplating.

25. The apparatus of claim 20, further comprising an atmospheric recirculation loop comprising the electrolyte reservoir, an atmospheric loop pump, and an atmospheric electrolyte reservoir, wherein the plating controller is configured to prevent the atmospheric recirculation loop from circulating during electroplating.

26. The apparatus of claim 20, further comprising a degassing electrolyte recirculation loop and an atmospheric recirculation loop, wherein the degassing electrolyte recirculation loop comprises the electrolyte reservoir, a pump, and a degassing electrolyte reservoir, and the atmospheric recirculation loop comprises the degassing electrolyte reservoir, a pump, and an atmospheric electrolyte reservoir, wherein the plating controller is configured to ensure that the degassing electrolyte recirculation loop is not circulating during electroplating.

27. The apparatus of claim 20, further comprising an additional electroplating cell configured to operate at or below about 100 Torr, wherein the additional electroplating cell is in fluidic communication with the electrolyte reservoir.

* * * * *